US011492227B1

(12) United States Patent
Sugizaki

(10) Patent No.: US 11,492,227 B1
(45) Date of Patent: Nov. 8, 2022

(54) SHEET POST-PROCESSING APPARATUS

(71) Applicant: TOSHIBA TEC KABUSHIKI KAISHA, Tokyo (JP)

(72) Inventor: Yoshiaki Sugizaki, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/371,806

(22) Filed: Jul. 9, 2021

(51) Int. Cl.
*B65H 37/04* (2006.01)

(52) U.S. Cl.
CPC ..... *B65H 37/04* (2013.01)

(58) Field of Classification Search
None
See application file for complete search history.

(56) References Cited

U.S. PATENT DOCUMENTS 7,862,025 B2 * 1/2011 Sugizaki ..... B42C 1/125 270/58.12
8,146,907 B2 * 4/2012 Kato ..... B65H 43/04 270/58.07
8,733,753 B2 * 5/2014 Soga ..... B65H 31/3081 270/58.09
9,126,797 B2 * 9/2015 Kikuchi ..... B65H 37/04
10,654,305 B2 * 5/2020 Shimizu ..... B42C 1/00
2008/0211160 A1 9/2008 Sugizaki
2009/0166946 A1 * 7/2009 Iguchi ..... B65H 31/10 270/58.08
2010/0194020 A1 * 8/2010 Iguchi ..... B65H 39/10 270/58.07
2012/0025441 A1 2/2012 Soga et al.

FOREIGN PATENT DOCUMENTS

JP 2000-219418 A 8/2000
JP 2005-314093 A 11/2005

* cited by examiner

*Primary Examiner* — Leslie A Nicholson, III
(74) *Attorney, Agent, or Firm* — Foley & Lardner LLP

(57) ABSTRACT

A sheet post-processing apparatus including a binding mechanism, a tray, a shift mechanism, and a control unit is provided. The binding mechanism is configured to apply binding to a sheet. The sheet applied with the binding is stacked on the tray. The shift mechanism is configured to perform a shift operation in which a side surface of the sheet is pushed and the sheet is deviated in a sheet width direction orthogonal to a discharge direction during discharge of the sheet to the tray. The control unit is configured to cause the shift operation to be performed by dividing the number of times for the shift operation into a plurality of times.

15 Claims, 15 Drawing Sheets

PRIOR ART

PRIOR ART

PRIOR ART

SHEET POST-PROCESSING APPARATUS

FIELD

Embodiments described herein relate generally to a sheet post-processing apparatus.

BACKGROUND

A sheet post-processing apparatus applies binding or the like to a sheet discharged from an image processing apparatus. For example, the image processing apparatus is an image forming apparatus that forms an image on a sheet, and the like. The sheet post-processing apparatus includes a tray on which a sheet bundle applied with the binding is stacked. A binding mechanism for applying the binding on the sheet includes a horizontal alignment plate that aligns the sheet bundle in a sheet width direction. For example, the binding mechanism applies the binding to a predetermined position in the vicinity of an upper left corner, an upper right corner of the sheet bundle, for example. If a large number of sheets applied with binding (hereinafter referred to as "bound sheet bundle") are stacked on the tray, a portion of the bound sheet bundle on a needle portion side is raised depending on a thickness of a staple needle. In the sheet post-processing apparatus, a predetermined number of bound sheet bundles are alternately offset in the sheet width direction and stacked on the tray so that raising due to the needle portion is low.

DETAILED DESCRIPTION

If a sheet post-processing apparatus as described above discharges the sheet bundle to the tray while shifting the sheet bundle in the sheet width direction, inertia still acts on the sheet bundle even after the shift operation is stopped. That is, even after the shift operation is stopped, the inertial force that tries to continue moving in the sheet width direction remains in the sheet bundle. If the shift operation is stopped during discharge of the sheet bundle, a portion near a rear end of the sheet bundle that continues to move comes into contact with one of stopped horizontal alignment plates. In this case, a linear motion of the sheet bundle in the sheet width direction changes to a rotational motion with a contact position between the portion near the rear end of the sheet bundle and the horizontal alignment plate acting as a fulcrum. With this configuration, the discharged sheet bundle may be stacked on the tray with a tip end inclined in a shift direction. If an inclination of the sheet bundle is large, the sheet bundle may fall from the tray.

At least one embodiment provides a sheet post-processing apparatus capable of suppressing the occurrence of inclination of a sheet bundle stacked on a tray.

In general, according to at least one embodiment, there is provided a sheet post-processing apparatus including a binding mechanism (binder) , a tray, a shift mechanism (shifter), and a control unit (controller). The binding mechanism is configured to apply binding to a sheet. The sheet applied with the binding is stacked on the tray. The shift mechanism is configured to perform a shift operation in which a side surface of the sheet is pushed and the sheet is deviated in a sheet width direction orthogonal to a discharge direction during discharge of the sheet to the tray. The control unit is configured to cause the shift operation to be performed by dividing the number of times for the shift operation into a plurality of times.

Figure 1:
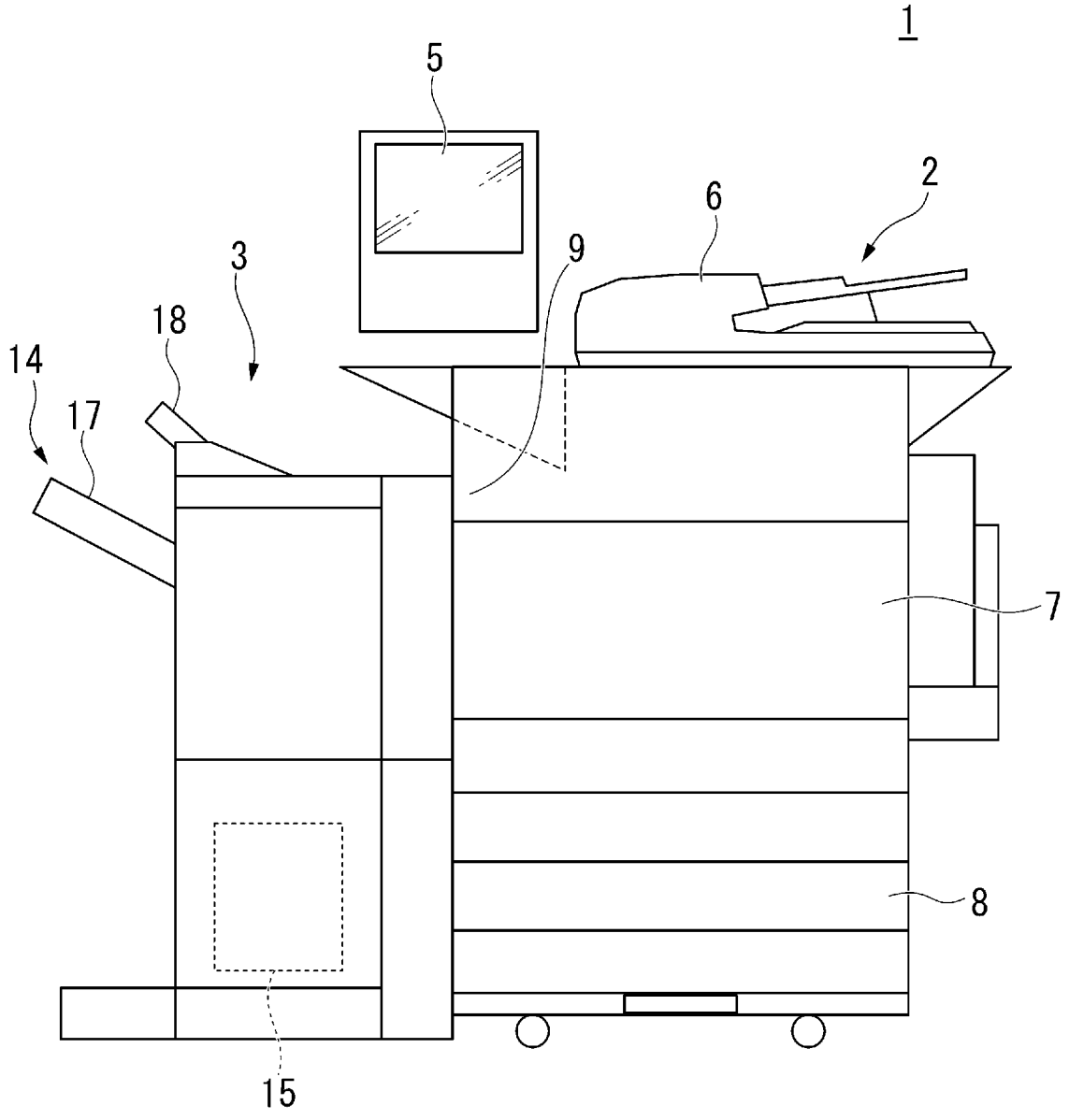
FIG. 1 is a schematic configuration diagram of an image processing system of a first embodiment.

Hereinafter, a configuration of a sheet post-processing apparatus of a first embodiment will be described with reference to the drawings. FIG. 1 is a schematic configuration diagram of an image processing system 1 of the first embodiment. As illustrated in FIG. 1, the image processing system 1 includes an image forming apparatus 2 and a sheet post-processing apparatus 3.

The image forming apparatus 2 forms an image on a sheet-like recording medium (hereinafter, referred to as "sheet") such as paper. The image forming apparatus 2 is an example of an image processing apparatus.

The sheet post-processing apparatus 3 executes post-processing on a sheet conveyed from the image forming apparatus 2. The post-processing includes stapling (hereinafter, referred to as "binding") in which a plurality of sheets are bound by a staple needle, for example. The post-processing may include any processing as long as the processing is processing executed after an image is formed by the image forming apparatus 2.

Hereinafter, a configuration of the image forming apparatus 2 will be described. The image forming apparatus 2 includes a control panel 5, a scanner unit 6, a printer unit 7, a sheet feeding unit 8, and a discharge unit 9.

The control panel 5 includes various keys, a touch panel, or the like that receives user's operations. The control panel 5 receives input regarding a type of post-processing of the sheet. Information about the type of post-processing input by the control panel 5 is transmitted to the sheet post-processing apparatus 3.

For example, the control panel 5 receives selection of an execution mode of post-processing. For example, the execution mode of post-processing includes a sort mode, a staple mode, a non-sort mode, and the like. The sort mode is an execution mode in which sorting is performed. The staple mode is an execution mode in which binding is performed. The non-sort mode is an execution mode in which sorting and binding are not performed. The image forming apparatus 2 transmits information about the execution mode of post-processing selected by the control panel 5 and a sheet discharge destination to the sheet post-processing apparatus 3.

The scanner unit 6 includes a reading unit that reads image information of an object to be copied. The scanner unit 6 sends the read image information to the printer unit 7.

The printer unit 7 forms an output image with a developer such as toner based on the image information transmitted from the scanner unit 6 or an external device. The printer unit 7 applies heat and pressure to a toner image transferred to the sheet to fix the toner image onto the sheet. The printer unit 7 may be a device that forms an image on the sheet by an ink jet method.

The sheet feeding unit 8 supplies the sheets one by one to the printer unit 7 in accordance with the timing when the printer unit 7 forms the toner image.

The discharge unit 9 conveys the sheet discharged from the printer unit 7 to the sheet post-processing apparatus 3.

Hereinafter, a configuration of the sheet post-processing apparatus 3 will be described.

As illustrated in FIG. 1, the sheet post-processing apparatus 3 is disposed adjacent to the image forming apparatus 2. The sheet post-processing apparatus 3 executes post-processing designated through the control panel 5 on the sheet conveyed from the image forming apparatus 2.

Figure 2:
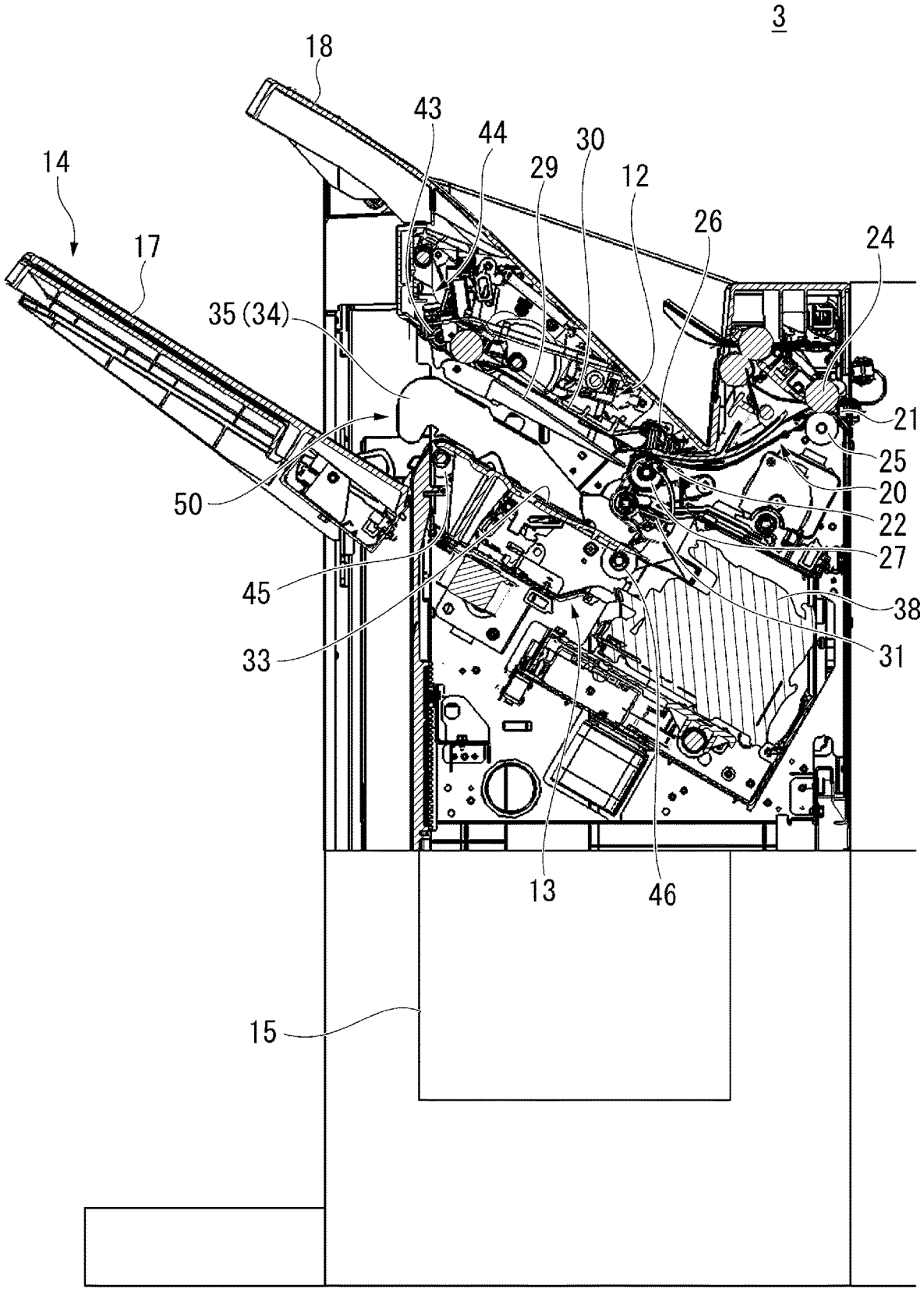
FIG. 2 is a schematic configuration diagram of a sheet post-processing apparatus.

FIG. 2 is a schematic configuration diagram of the sheet post-processing apparatus 3 of the first embodiment. As illustrated in FIG. 2, the sheet post-processing apparatus 3 includes a standby unit 12, a processing unit 13, a discharge unit 14, and a post-processing control unit 15.

The standby unit 12 causes the sheet conveyed from the image forming apparatus 2 to stay temporarily (see FIG. 1). The standby unit 12 includes a standby tray 29 that receives the sheet conveyed from the image forming apparatus 2. For example, the standby unit 12 makes a plurality of subsequent sheets standby while the processing unit 13 performs post-processing of a preceding sheet. The standby unit 12 is disposed above the processing unit 13. For example, the standby unit 12 superposes a plurality of preset sheets on top of each other and makes the plurality of preset sheets stand by. If the processing unit 13 is vacant, the standby unit 12 makes the sheet staying in standby fall toward the processing unit 13.

The processing unit 13 includes a processing tray 33 that receives the sheet fallen from the standby unit 12. The processing unit 13 executes post-processing on the conveyed sheet. The processing unit 13 executes post-processing on a sheet bundle in which a plurality of sheets are aligned. For example, post-processing executed by the processing unit 13 is binding by a stapler 38. The processing unit 13 discharges the sheet bundle applied with post-processing to the discharge unit 14.

The discharge unit 14 includes a movable tray 17 and a fixed tray 18. The movable tray 17 and the fixed tray 18 are exposed to the outside of the apparatus main body of the sheet post-processing apparatus 3. The discharge unit 14 includes a sheet discharge port capable of discharging a sheet for each of the movable tray 17 and the fixed tray 18.

The movable tray 17 is provided on a side portion of the sheet post-processing apparatus 3. The movable tray 17 can discharge the sheet after being subjected to execution of the post-processing from the processing unit 13. The movable tray 17 is vertically movable along the side portion of the sheet post-processing apparatus 3.

The fixed tray 18 is provided on an upper portion of the sheet post-processing apparatus 3. For example, the sheet conveyed via the discharge unit 9 (see FIG. 1) of the image forming apparatus 2 can be directly discharged to the fixed tray 18.

The post-processing control unit 15 controls an operation of each functional unit of the sheet post-processing apparatus 3. For example, the post-processing control unit 15 controls operations of the standby unit 12, the processing unit 13, and the discharge unit 14. The post-processing control unit 15 includes a processor, a memory, a storing unit, for example, connected by a bus.

Hereinafter, the image forming apparatus 2 side, which is an upstream side in a sheet conveyance direction, is referred to as an "upstream side". Hereinafter, the discharge unit 14 side, which is a downstream side in the sheet conveyance direction, is referred to as a "downstream side". Hereinafter, a downstream side end portion in the sheet conveyance direction is referred to as a "tip end portion". Hereinafter, an upstream side end portion in the sheet conveyance direction is referred to as a "rear end portion". Hereinafter, a direction parallel to the plane of the sheet and orthogonal to the sheet conveyance direction is referred to as a "sheet width direction".

As illustrated in FIG. 2, the sheet post-processing apparatus 3 includes a conveyance path 20 for conveying the sheet following the discharge unit 9 (see FIG. 1) of the image forming apparatus 2. The conveyance path 20 includes a sheet supply port 21 and a sheet carrying-out port 22.

The sheet supply port 21 is provided with a pair of inlet rollers 24 and 25. The sheet supply port 21 faces the discharge unit 9 (see FIG. 1) of the image forming apparatus 2. A sheet is supplied to the sheet supply port 21 from the image forming apparatus 2. The sheet carrying-out port 22 is provided with a pair of outlet rollers 26 and 27. The sheet carrying-out port 22 faces the standby unit 12. The sheet passed through the conveyance path 20 is conveyed from the sheet carrying-out port 22 to the standby unit 12.

For example, the post-processing control unit 15 (see FIG. 1) controls operations of the inlet rollers 24 and 25 and the outlet rollers 26 and 27. The inlet rollers 24 and 25 and the outlet rollers 26 and 27 convey the sheet to the standby tray 29.

The standby unit 12 includes the standby tray 29 and an assist guide 30. The rear end portion of the standby tray 29 is disposed in the vicinity of the outlet rollers 26 and 27. The rear end portion of the standby tray 29 is disposed below the sheet carrying-out port 22 of the conveyance path 20. The standby tray 29 is installed with an inclination with respect to the horizontal direction so as to be gradually raised toward the downstream side in the sheet conveyance direction. In the standby tray 29, a plurality of sheets are piled up and are stayed in standby while the post-processing is performed by the processing unit 13.

The standby tray 29 includes a pair of tray members that can approach and separate from each other in the sheet width direction. If the sheet is stayed in standby on the standby tray 29, the pair of tray members can approach closely to each other to support the sheet. If the sheet is moved from the standby tray 29 toward the processing tray 33 of the processing unit 13, the pair of tray members are separated from each other. With this configuration, the standby tray 29 makes the supported sheet fall toward the processing tray 33.

The assist guide 30 is provided above the standby tray 29. For example, the assist guide 30 has substantially a same length as the standby tray 29 in the sheet conveyance direction. If the sheet moves from the standby tray 29 toward the processing tray 33, the assist guide 30 urges the sheet toward the processing tray 33. The assist guide 30 includes a swing shaft at an end portion on the downstream side in the sheet conveyance direction. The assist guide 30 swings an end portion on the upstream side in the sheet conveyance direction downward by the swing shaft to urge the sheet toward the processing tray 33.

A paddle 31 is provided between the rear end portion of the standby tray 29 and the rear end portion of the processing tray 33. The paddle 31 presses the sheet toward the processing tray 33 by rotating around a rotation axis along the sheet width direction. If the sheet moves from the standby tray 29 toward the processing tray 33, the paddle 31 presses the rear end portion of the sheet toward the processing tray 33. For example, the paddle 31 is made of an elastic material such as rubber.

Figure 3:
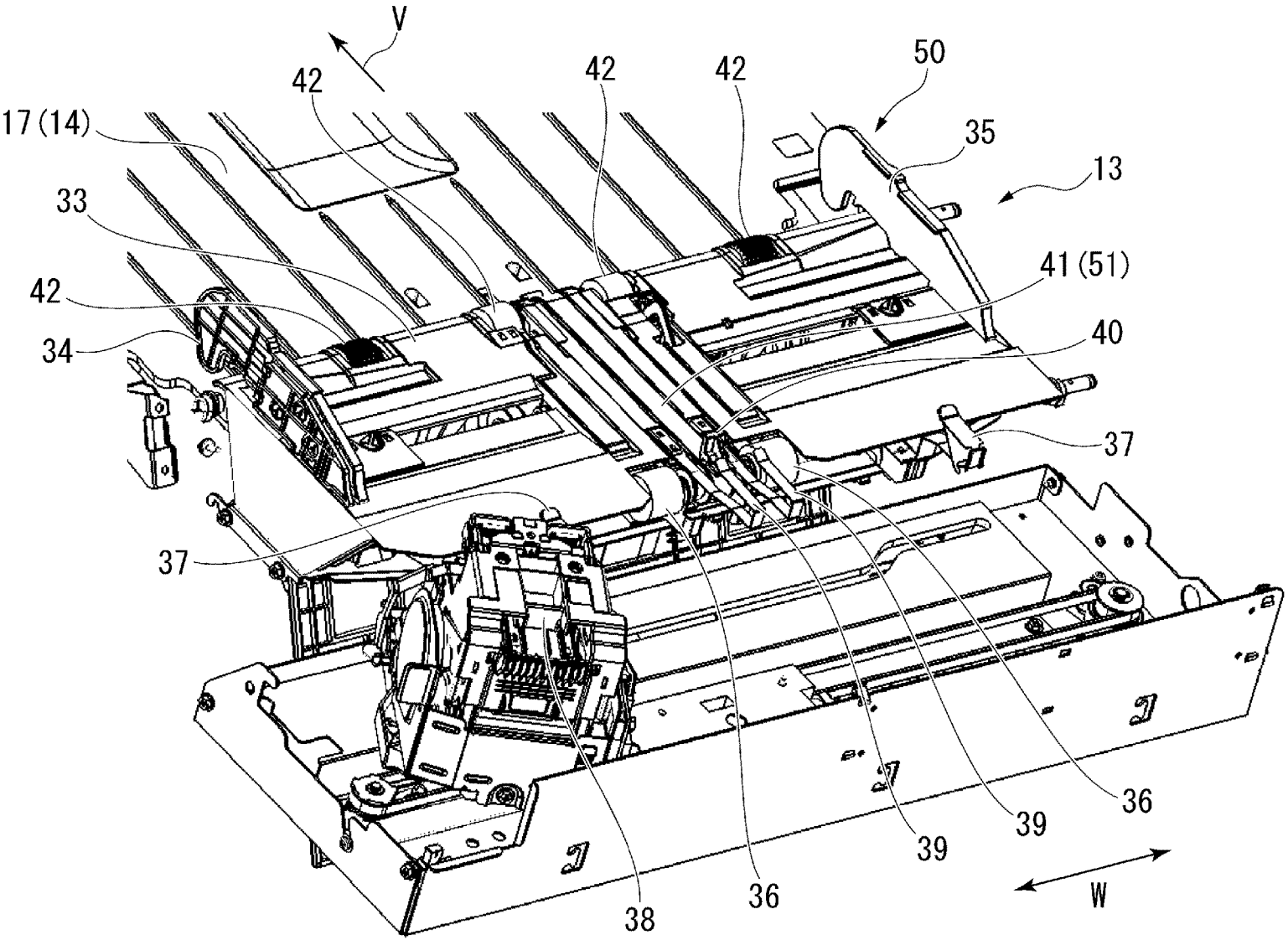
FIG. 3 is a perspective view of the sheet post-processing apparatus when viewed from an upstream side in a sheet conveyance direction.
Figure 4:
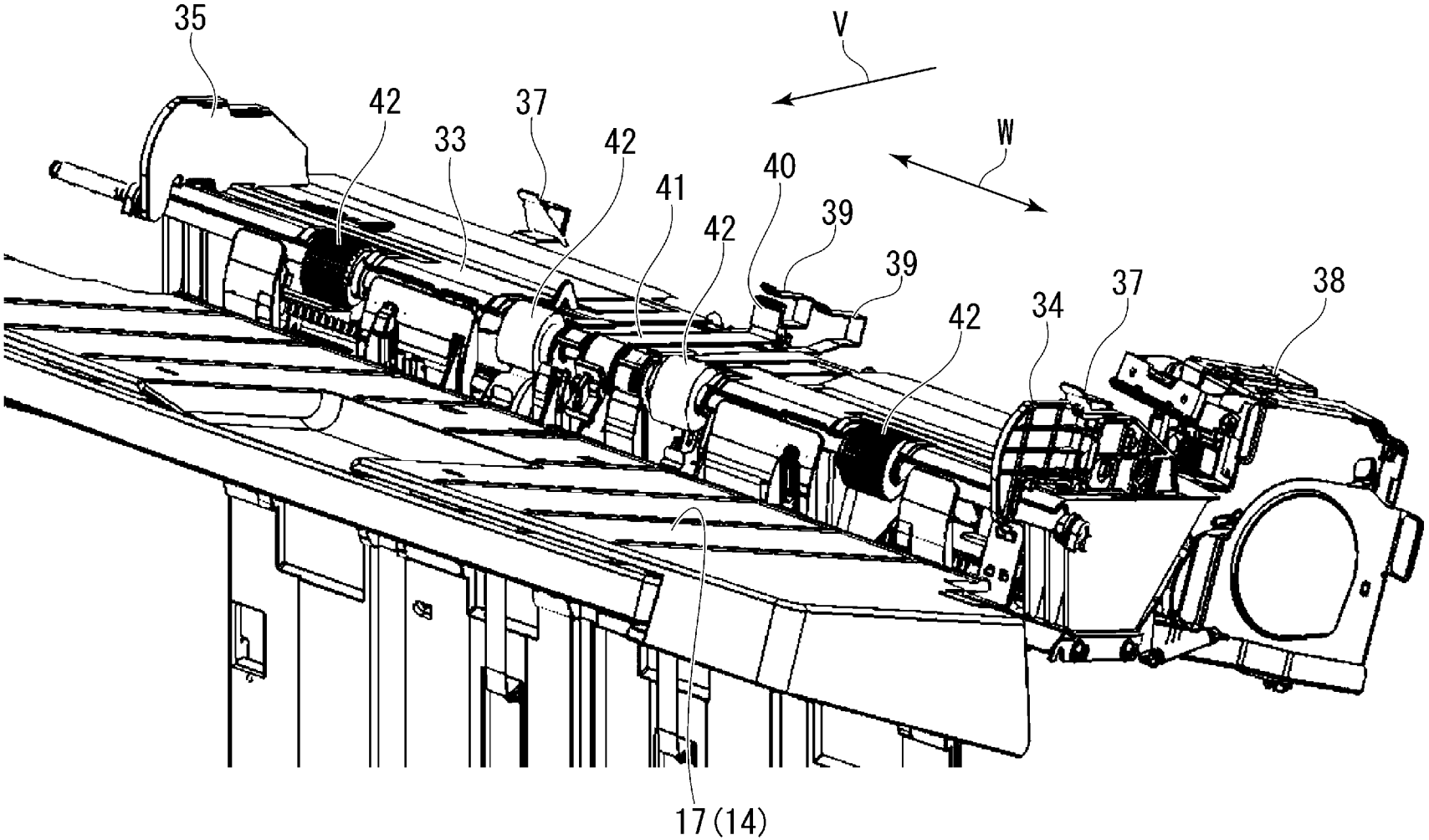
FIG. 4 is a perspective view of the sheet post-processing apparatus when viewed from a downstream side in the sheet conveyance direction.

FIG. 3 is a perspective view of the sheet post-processing apparatus 3 of the first embodiment when viewed from the upstream side in the sheet conveyance direction. FIG. 4 is a perspective view of the sheet post-processing apparatus 3 of the first embodiment when viewed from the downstream side in the sheet conveyance direction. In FIG. 3 and FIG. 4, reference numeral V indicates the sheet conveyance direction, and reference numeral W indicates the sheet width direction.

As illustrated in FIG. 3, the processing unit 13 includes the processing tray 33, horizontal alignment plates 34 and 35, a vertical alignment roller 36, a rear end stopper 37, the stapler 38, an ejector 39, a holding claw 40, a belt 41, and discharge rollers 42 and 43 (see FIG. 2).

As illustrated in FIG. 2, the processing tray 33 is provided below the standby tray 29. The processing tray 33 is installed with an inclination with respect to the horizontal direction so as to be gradually raised toward the downstream side in the sheet conveyance direction. For example, the processing tray 33 is installed in parallel with the standby tray 29 installed in an inclined manner. The upper surface of the processing tray 33 has a conveyance surface on which the sheet is placed.

As illustrated in FIG. 4, the horizontal alignment plates and 35 are provided on the conveyance surface of the processing tray 33. The pair of horizontal alignment plates 34 and 35 are installed at positions separated from each other in a sheet width direction W. The pair of horizontal alignment plates 34 and 35 have inner side surfaces facing each other in the sheet width direction W. The horizontal alignment plates 34 and 35 can move in the direction of approaching each other and the direction of separating from each other in the sheet width direction W. The horizontal alignment plates 34 and 35 configure a horizontal alignment device for aligning sheets in the sheet width direction W (hereinafter, referred to as "horizontal alignment"). For example, the horizontal alignment is performed by the inner side surfaces of the horizontal alignment plates 34 and 35 abutting on the side surface of the sheet in the sheet width direction W.

As illustrated in FIG. 3, the vertical alignment roller 36 and the rear end stopper 37 are provided at the rear end portion of the processing tray 33. The vertical alignment roller 36 conveys the sheet placed on the processing tray 33 toward the rear end stopper 37 in cooperation with the discharge roller 42. The vertical alignment roller 36 and the discharge roller 42 make the sheet abut on the rear end stopper 37 to align the sheet in the sheet conveyance direction V (hereinafter, referred to as "vertical alignment").

The stapler 38 is provided at the rear end portion of the processing tray 33. If the staple mode is selected, the stapler 38 binds a bundle of a plurality of sheets placed on the processing tray 33. The stapler 38 can be moved within a specified range so as to bind a predetermined position of the sheet bundle. The predetermined position of the sheet bundle is, for example, a position instructed by the user via the control panel.

The ejector 39 is provided at the rear end portion of the processing tray 33. The ejector 39 can move toward the downstream side in the sheet conveyance direction V. The ejector 39 delivers the sheet bundle subjected to execution of post-processing to the holding claw 40.

Figure 5:
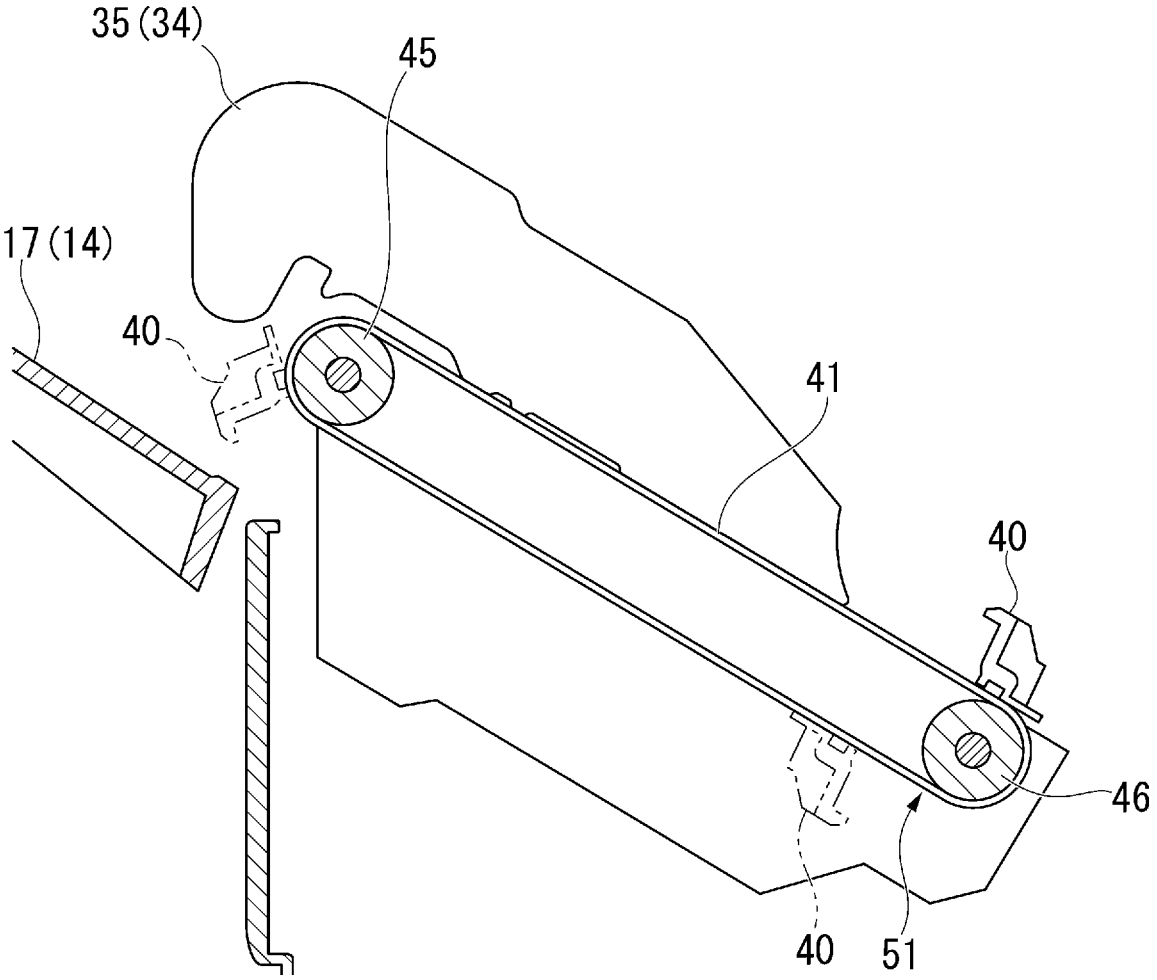
FIG. 5 is a schematic configuration diagram of a shift mechanism.

The holding claw 40 can hold the sheet bundle from the upstream side in the sheet conveyance direction V. The holding claw 40 is attached to the belt 41. As illustrated in FIG. 5, the belt 41 is stretched over a pair of pulleys 45 and 46. The pair of pulleys 45 and 46 rotate in conjunction with rotational drive of a drive roller of the processing tray 33. These belts 41, pulleys 45 and 46, and drive roller configure a moving mechanism 51 capable of moving the holding claw 40.

As the belt 41 moves, the holding claw 40 moves in the sheet conveyance direction V and the opposite direction. In FIG. 5, the holding claw 40 disposed at the rear end portion of the belt 41 is illustrated by a solid line. The holding claws 40 disposed, as the belt 41 moves, at the tip end portion of the belt 41 and the lower portion on the upstream side are illustrated by broken lines. As illustrated in FIG. 4, the holding claw 40 discharges the bundle of sheets delivered from the ejector 39, together with the discharge roller 42, toward the movable tray 17 of the discharge unit 14.

The discharge rollers 42 and 43 include a discharge drive roller 42 and a discharge pinch roller 43. The discharge drive roller 42 is provided at the tip end portion of the processing tray 33. The discharge drive roller 42 comes into contact with the sheet guided to the conveyance surface of the processing tray 33 from below. The discharge drive roller 42 discharges the sheet placed on the processing tray 33 from the processing tray 33 toward the movable tray 17 of the discharge unit 14.

As illustrated in FIG. 2, the discharge pinch roller 43 is provided above the discharge drive roller 42 (see FIG. 4). The discharge pinch roller 43 is a driven roller that does not includes a drive source. The discharge pinch roller 43 is movable between a standby position positioned above the standby tray 29 and a rotation position facing the discharge drive roller 42. The discharge pinch roller 43 is driven by a pinch roller drive mechanism 44 to move between the standby position and the rotation position. The discharge pinch roller 43 moves to the rotation position to pinch the sheet between the discharge pinch roller 43 and the discharge drive roller 42. With this configuration, the rotation of the discharge drive roller 42 is stably transmitted to the sheet.

The post-processing control unit 15 (see FIG. 1) determines an operation mode of the sheet post-processing apparatus 3. For example, the operation mode of the sheet post-processing apparatus 3 includes an automatic post-processing mode and a manual operation mode. For example, if the automatic post-processing mode is selected on the control panel 5, the post-processing control unit 15 determines that the operation mode of the sheet post-processing apparatus is the automatic post-processing mode. If the manual operation mode is selected on the control panel 5, the post-processing control unit 15 determines that the operation mode of the sheet post-processing apparatus 3 is the manual operation mode.

The post-processing control unit 15 instructs the processing unit 13 (see FIG. 2) to execute aligning. The aligning is a process of aligning the positions of the end portions of a plurality of sheets in the width direction and the length direction. If the processing unit 13 executes the aligning, the horizontal alignment plates 34 and 35 and the vertical alignment roller 36 operate to align the positions of the end portions of the plurality of sheets in the width direction and the length direction. The length direction of the sheet is the direction of the sheet surface and parallel to the sheet conveyance direction.

The post-processing control unit 15 instructs the stapler 38 (see FIG. 2) to execute post-processing. Upon receiving the instruction to execute the post-processing, the stapler 38 executes binding on the sheet bundle. The post-processing control unit 15 instructs the ejector 39 (see FIG. 3) to execute discharging. Upon receiving the instruction to execute the discharging, the ejector 39 discharges the sheet bundle subjected to execution of the post-processing to the outside of the sheet post-processing apparatus 3.

Next, a shift mechanism 50 will be described. As illustrated in FIG. 2, the sheet post-processing apparatus 3 includes the shift mechanism 50 that shifts a sheet bundle after being applied with binding (hereinafter, referred to as "bound sheet bundle"). The shift referred to here is to deviate the position of the bound sheet bundle in the sheet width direction W.

As illustrated in FIG. 3, the shift mechanism 50 includes the horizontal alignment plates 34 and 35, the rear end stopper 37, the ejector 39, the holding claw 40, the moving mechanism 51, and the discharge drive roller 42 described above.

The horizontal alignment plates 34 and 35 can be moved from the standby position to the inside of the standby position in the sheet width direction W. The standby position referred to here is a position where the inner side surfaces of the horizontal alignment plates 34 and 35 are separated from the side surfaces of the sheet bundle in the sheet width direction W.

The shift mechanism 50 shifts the sheet bundle in the sheet width direction W. The shift mechanism 50 positions the side surface on the binding position side of the bound sheet bundle at a predetermined position (hereinafter, referred to as "first shift position"). Alternatively, the shift mechanism 50 positions the side surface on the binding position side of the bound sheet bundle at a predetermined position (hereinafter, referred to as "second shift position") different from the first shift position.

Figure 6:
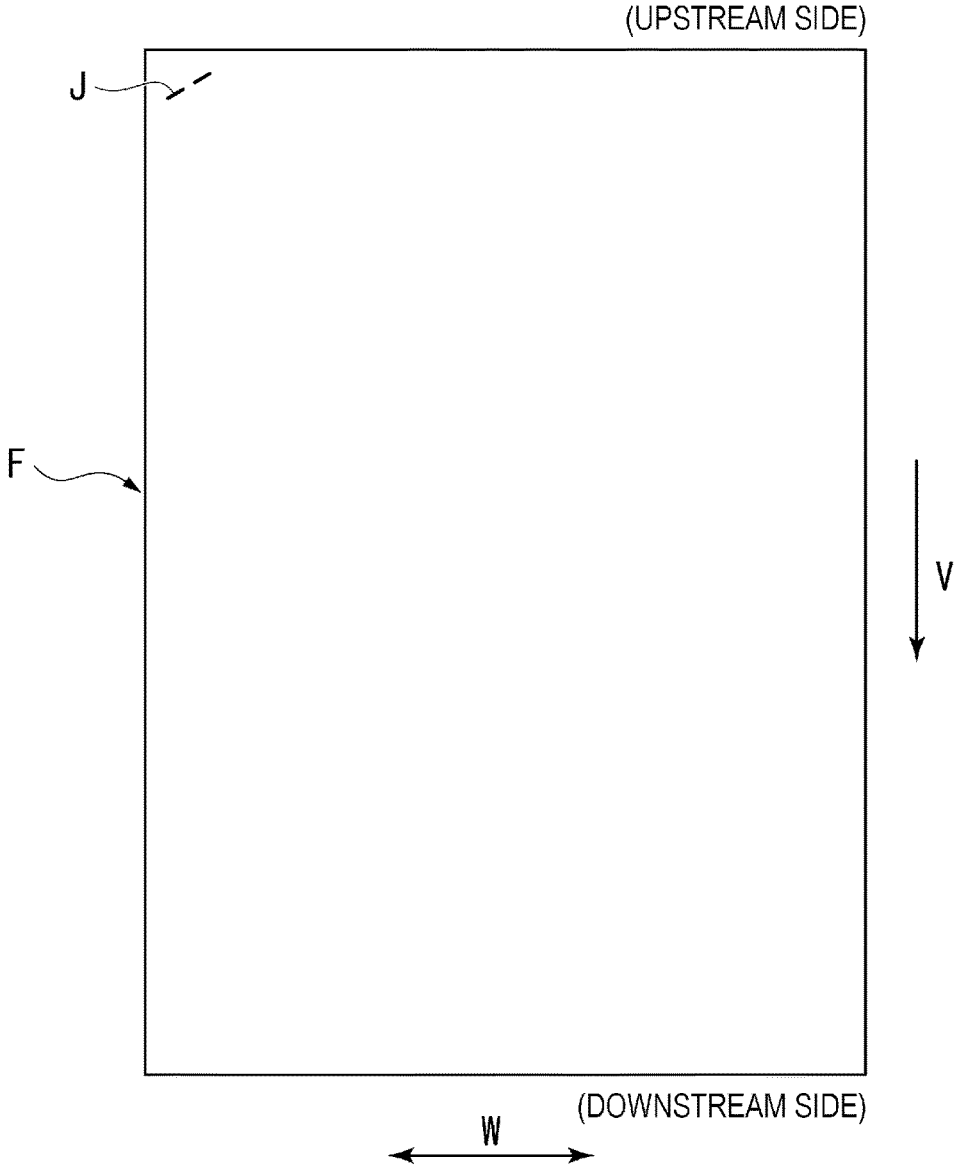
FIG. 6 is a plan view for illustrating a binding position of a bound sheet bundle.

As illustrated in FIG. 6, in at least one embodiment, binding is applied to only one place in the vicinity of the upper left corner of a rectangular sheet bundle having a longitudinal side in the sheet conveyance direction V in plan view. The side surface on the binding position side of the bound sheet bundle referred to here is the side surface on the left side of the bound sheet bundle in front view when viewed from the downstream side to the upstream side in the sheet conveyance direction V. In FIG. 6, reference numeral F indicates the side surface on the binding position side of the bound sheet bundle.

Figure 7:
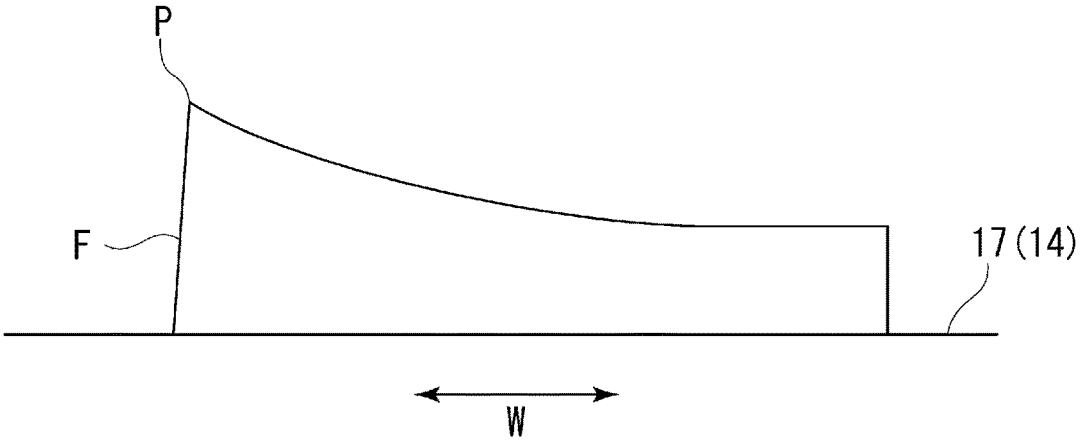
FIG. 7 is a front view for illustrating a raised portion of the bound sheet bundle.

As illustrated in FIG. 7, when a large number of bound sheet bundles are piled up on the movable tray 17, the portion on the binding position side is raised. In at least one embodiment, as described above, binding is applied to only one place in the vicinity of the upper left corner of the rectangular sheet bundle in plan view. For that reason, a large number of bound sheet bundles piled up on the movable tray 17 have a raised portion P at the left end portion in front view when viewed from the downstream side to the upstream side in the sheet conveyance direction V.

Figure 8:
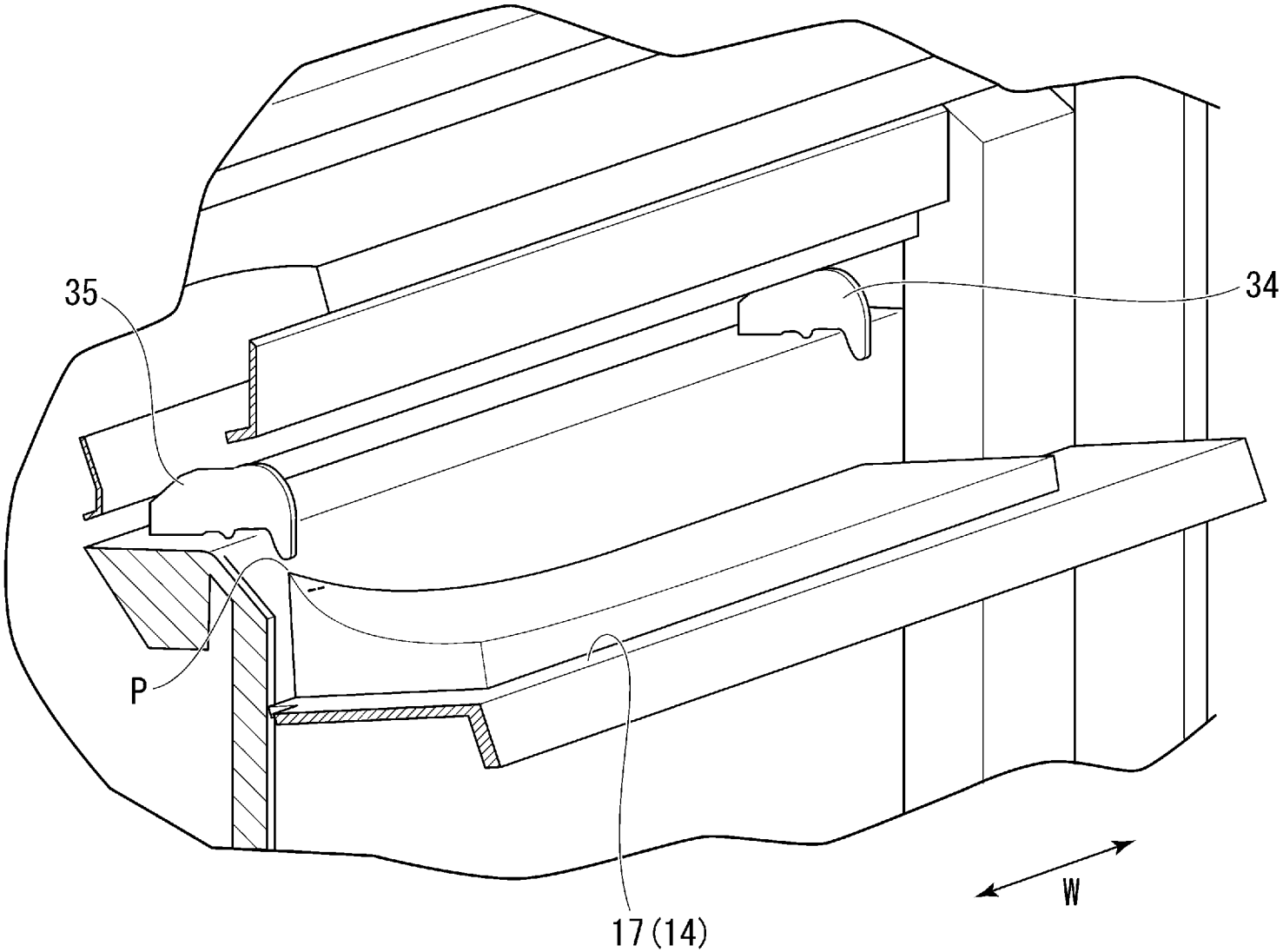
FIG. 8 is a perspective view for illustrating the raised portion of the bound sheet bundle.

In FIG. 8, reference numeral 34 indicates a horizontal alignment plate (hereinafter referred to as "first horizontal alignment plate") disposed on one side of the sheet width direction W (right side in front view), and reference numeral indicates a horizontal alignment plate (hereinafter referred to as "second horizontal alignment plate") disposed on the other side of the sheet width direction W (left side in front view) . In other words, the side surface on the binding position side of the bound sheet bundle described above is the side surface on the second horizontal alignment plate 35 side in the sheet width direction W.

The shift mechanism 50 shifts the position of the bound sheet bundle in the sheet width direction W by pushing the side surface on the binding position side of the bound sheet bundle with the second horizontal alignment plate 35 during discharge of the bound sheet bundle. The shift mechanism 50 moves the holding claw 40 toward the downstream side in the sheet conveyance direction V (see FIG. 3) by the moving mechanism 51, with the bound sheet bundle held from the upstream side in the sheet conveyance direction by the holding claw 40, during discharge of the bound sheet bundle.

For example, the holding claw 40 discharges the bound sheet bundle toward the movable tray 17 in cooperation with the discharge drive roller 42. That is, the shift mechanism 50 discharges the bound sheet bundle by the shift operation by the horizontal alignment plates 34 and 35 and the discharge operation by the holding claw 40 and the discharge drive roller 42. With this configuration, the bound sheet bundle is discharged toward the movable tray 17 while being shifted in the sheet width direction W. The movable tray 17 is an example of a tray on which the bound sheet bundle is stacked.

In at least one embodiment, the shift mechanism 50 shifts the bound sheet bundle in the sheet width direction W, with the discharge pinch roller 43 in the standby position during discharge of the bound sheet bundle. That is, during the discharge of the bound sheet bundle, the shift mechanism 50 does not use the discharge pinch roller 43, but performs the discharge operation by the discharge drive roller 42. For that reason, the bound sheet bundle is not pinched between the discharge drive roller 42 and the discharge pinch roller 43 during the discharge of the bound sheet bundle. With this configuration, the bound sheet bundle can be smoothly shifted in the sheet width direction W during discharge of the bound sheet bundle.

The shift mechanism 50 shifts the bound sheet bundle by setting spacing of the pair of horizontal alignment plates 34 and 35 in the sheet width direction W based on the sheet width of the bound sheet bundle during discharge of the bound sheet bundle. The shift mechanism 50 moves the side surface on the binding position side of the bound sheet bundle from the first shift position to the second shift position. In this case, the post-processing control unit 15 controls the shift operation of the second horizontal alignment plate 35, which is the horizontal alignment plate on the side where the bound sheet bundle is pushed, so as to be performed by dividing the number of times for the shift operation into a plurality of times.

Hereinafter, the shift operation by the shift mechanism 50 of the first embodiment will be described in detail.

Figure 9:
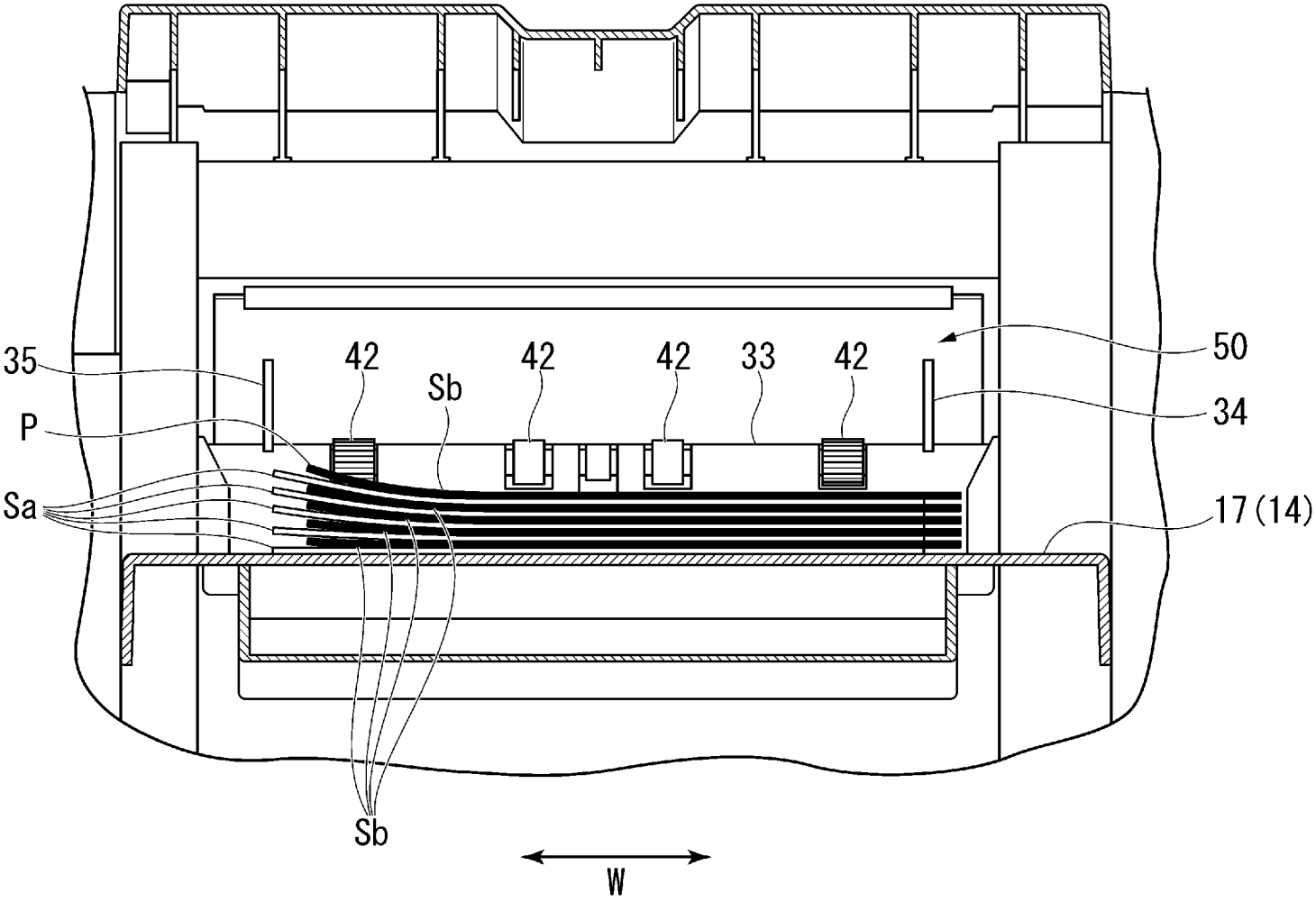
FIG. 9 is a front view for illustrating the bound bundle sheet piled up on a movable tray by an operation of the shift mechanism.

FIG. 9 is a front view for illustrating the bound sheet bundle piled up on the movable tray 17 by the shift operation. In FIG. 9, the second horizontal alignment plate 35 is disposed at the first shift position. The first horizontal alignment plate 34 is disposed at a position of a side surface on a side opposite to the bound sheet bundle if the side surface on the binding position side of the bound sheet bundle is in the first shift position.

The shift mechanism 50 performs an operation of shifting the bound sheet bundle (hereinafter, referred to as "first shift operation") so that the side surface on the binding position side of the bound sheet bundle is positioned at the first shift position. The shift mechanism 50 performs an operation of shifting the bound sheet bundle (hereinafter, referred to as "second shift operation") so that the side surface on the binding position side of the bound sheet bundle is positioned at the second shift position. The shift mechanism 50 alternately repeats the first shift operation and the second shift operation.

For example, first, the shift mechanism 50 stacks one bound sheet bundle on the movable tray 17 by the first shift operation. In the first shift operation, one bound sheet bundle (hereinafter referred to as "first shift position sheet bundle") is shifted so that the side surface on the binding position side of the bound sheet bundle is the same as the first shift position in the sheet width direction W. In FIG. 9, reference numeral Sa indicates the first shift position sheet bundle.

Next, the shift mechanism 50 stacks one bound sheet bundle on the first shift position sheet bundle Sa on the movable tray 17 by the second shift operation. For example, in the second shift operation, one bound sheet bundle (hereinafter referred to as a "second shift position sheet bundle") is shifted so that the side surface on the binding position side of the bound sheet bundle is at the second shift position in the sheet width direction W. In FIG. 9, reference numeral Sb indicates the second shift position sheet bundle.

In at least one embodiment, in the second shift operation, the second shift position sheet bundle Sb is shifted so that the side surface on the binding position side of the second shift position sheet bundle Sb is inside a binding position J (see FIG. 6) of the first shift position sheet bundle Sa in the sheet width direction W. Here, the binding position J corresponds to an inner end of the staple needle provided on the bound sheet bundle in the sheet width direction W.

For example, in the second shift operation, the staple needle provided on the second shift position sheet bundle Sb may be offset inward from the staple needle provided on the first shift position sheet bundle Sa in the sheet width direction W.

For example, the shift mechanism 50 alternately repeats the first shift operation and the second shift operation, and piles up a plurality of bound sheet bundles on the movable tray 17. For example, the shift mechanism 50 piles up the sheet bundles until the raised portion P reaches a predetermined height.

The raised portion referred to here means a portion that protrudes most upwardly in the plurality of bound sheet bundles piled up on the movable tray 17. As illustrated in FIG. 9, in at least one embodiment, the raised portion P is, for example, a side end on the binding position side of the second shift position sheet bundle Sb positioned at the uppermost position among the plurality of bound sheet bundles piled up on the movable tray 17.

Hereinafter, a series of flow of the shift operation by the shift mechanism 50 of this embodiment will be described. In order to make it easier to understand the description of a series of flow of the shift operations by the shift mechanism 50 of this embodiment, a series of flow of a shift operation in the related art will be described first.

FIG. 10 to FIG. 13 are diagrams illustrating a series of flow of the shift operation in the related art. FIG. 10 to FIG. 13 illustrate a flow of the second shift operation in which the side surface on the binding position side of the bound sheet bundle is positioned at the second shift position.

Although the description of the flow of the first shift operation is omitted, the first shift operation is essentially the same as that of the second shift operation described below. In the first shift operation, moving directions of the horizontal alignment plates 34 and 35 and the bound sheet bundle are only opposite to those of the second shift operation described below. Alternatively, the first shift operation may be a discharge operation that does not shift the bound sheet bundle.

Figure 10:
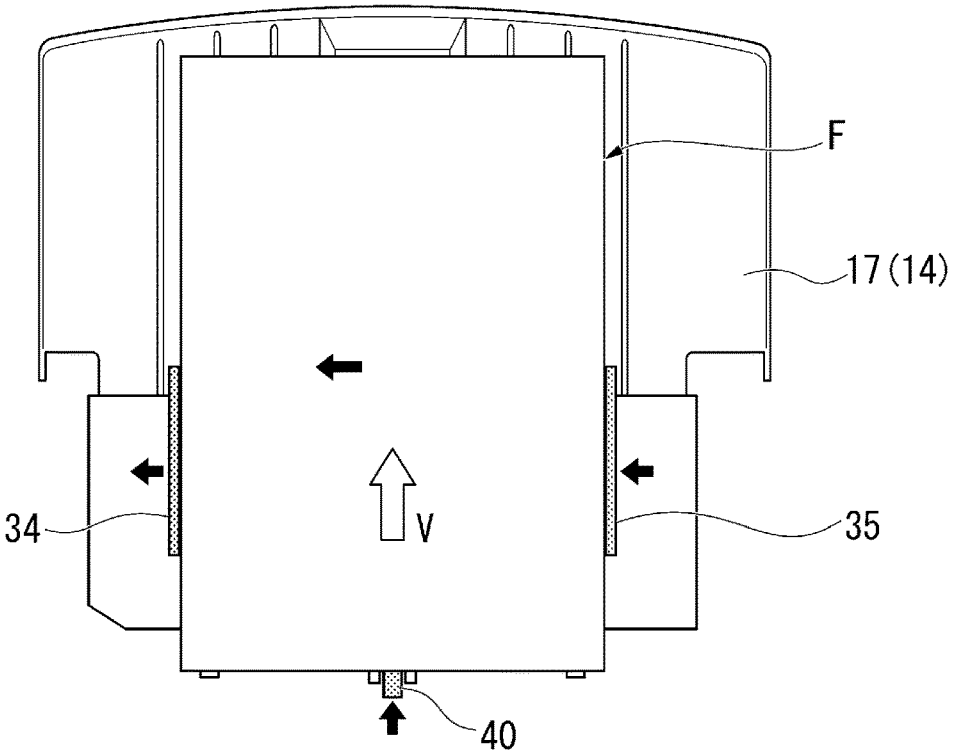
FIG. 10 is a diagram illustrating a series of flow of a shift operation according to the related art.

FIG. 10 illustrates a state at a point in time when discharge of the bound sheet bundle is started. At this point in time, the second horizontal alignment plate 35 is positioned at the first shift position. At this point in time, the holding claw 40 is positioned on the most upstream side in the sheet conveyance direction V in a movable range.

From this state, the holding claw 40 moves while pushing the bound sheet bundle toward the downstream side in the sheet conveyance direction V by the moving mechanism 51. At the same time, the first horizontal alignment plate 34 and the second horizontal alignment plate 35 move from the right side to the left side of FIG. 10 while maintaining sheet width spacing. In this case, the second horizontal alignment plate 35 moves from the first shift position to the second shift position.

Figure 11:
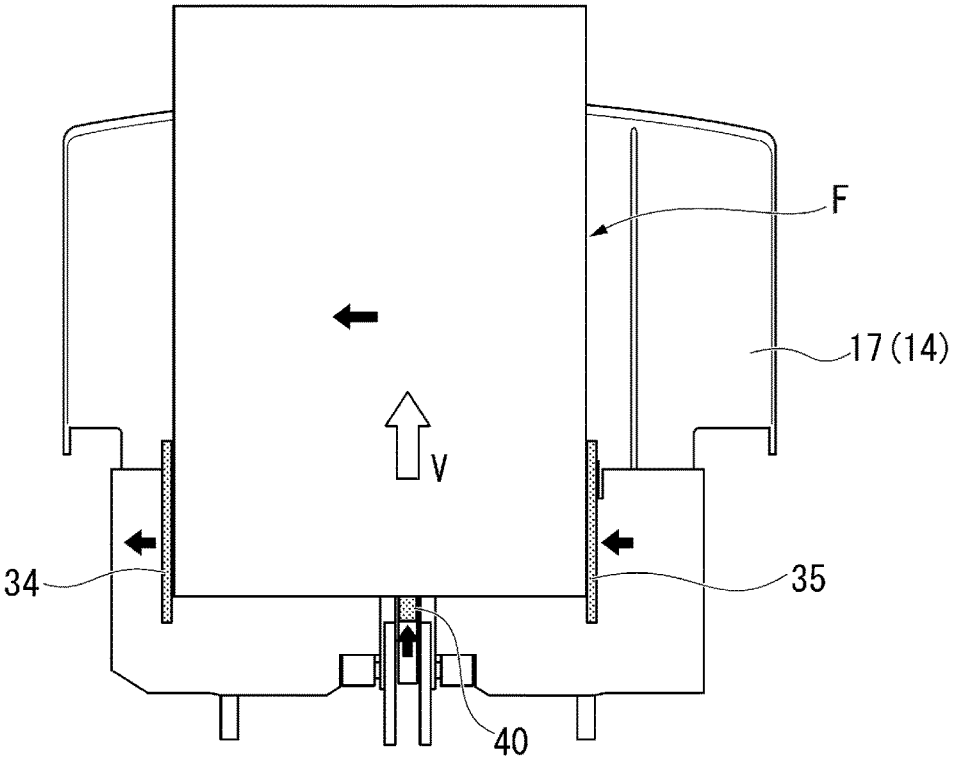
PRIOR ART FIG. 11
FIG. 11 is another diagram illustrating the series of flow of the shift operation according to the related art.

FIG. 11 illustrates the state at the point in time when the discharge of the bound sheet bundle is started and the shift operation is being performed. At this point in time, the second horizontal alignment plate 35 is positioned between the first shift position and the second shift position. At this point in time, the holding claw 40 is positioned between the most upstream side position and the most downstream side position in the sheet conveyance direction V in the movable range.

At this point in time, the bound sheet bundle is guided from both sides by the first horizontal alignment plate 34 and the second horizontal alignment plate 35, and is carried straight along the sheet conveyance direction V.

Figure 12:
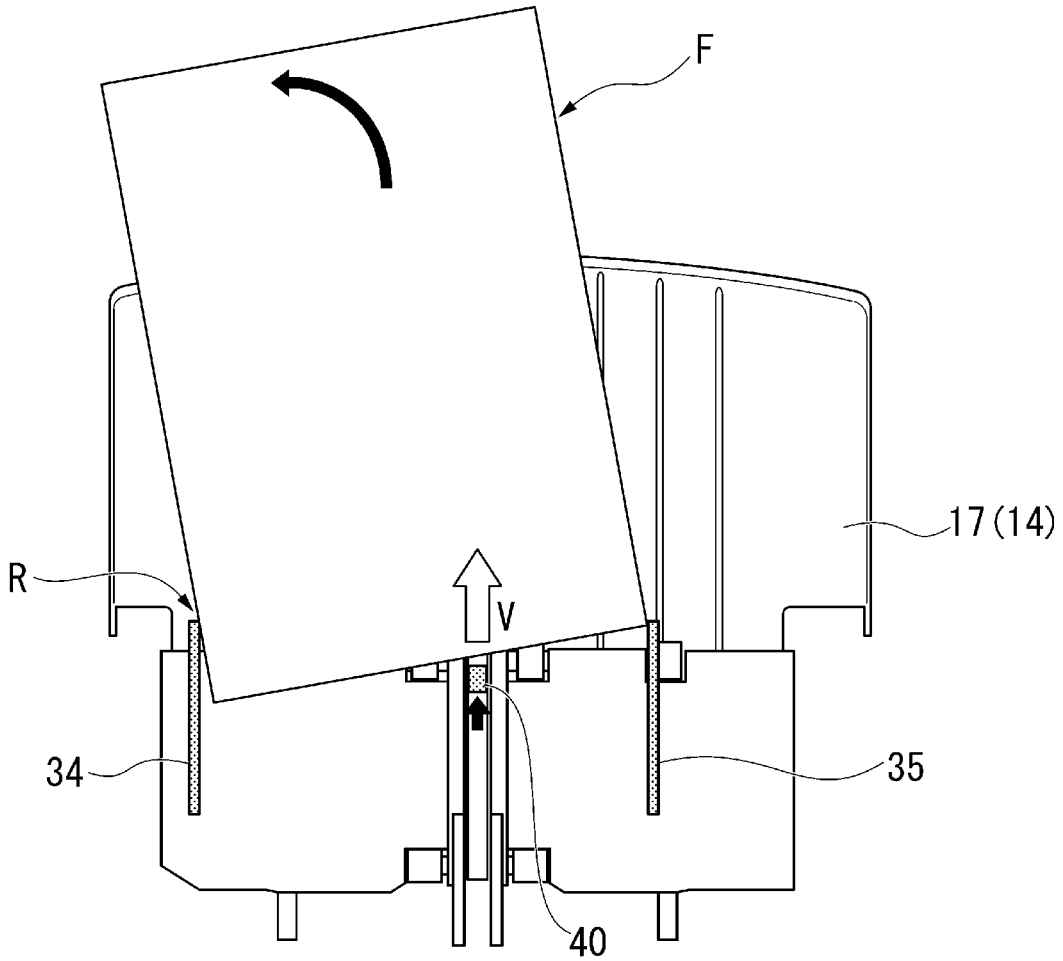
FIG. 12 is another diagram illustrating the series of the shift operation.

FIG. 12 indicates the state at the point in time when the shift operation is completed. At this point in time, the second horizontal alignment plate 35 is positioned at the second shift position. At this point in time, the holding claw 40 is positioned at the most downstream side position in the sheet conveyance direction V in the movable range.

If the bound sheet bundle is discharged to the movable tray 17 or the like while being shifted in the sheet width direction W, the law of inertia still acts on the bound sheet bundle even after the shift operation is stopped. That is, even after the shift operation is stopped, the bound sheet bundle retains an inertial force that tries to continue moving in the sheet width direction W. If the shift operation is stopped during discharge of the bound sheet bundle, a portion near the rear end portion of the bound sheet bundle that tries to continue moving comes into contact with the stopped first horizontal alignment plate 34. In FIG. 12, reference numeral R is a contact position.

In this case, a linear motion of the bound sheet bundle in the sheet width direction W changes to a rotational motion with the contact position R between the portion near the rear end portion of the bound sheet bundle and the first horizontal alignment plate 34 acts as a fulcrum. As illustrated in FIG. 12, the tip end of the bound sheet bundle begins to incline toward the left side direction of FIG. 12 due to the rotational motion with the contact position R as the fulcrum.

A factor that causes the bound sheet bundle to incline is not limited to the rotational motion caused by such inertial force. Another factor that causes the bound sheet bundle to incline is due to change in the relative positional relationship between the bound sheet bundle and the holding claw 40.

Specifically, the position where the bound sheet bundle is pushed by the holding claw 40 during a discharging operation is moved from a position near a center to a position near an end portion in the sheet width direction W by the shift operation. In FIG. 12, the position where the bound sheet bundle is pushed by the holding claw 40 moves from the center to the right side direction. With this configuration, the holding claw 40 pushes the rear end portion on the right side of the bound sheet bundle toward the latter half of the discharging operation, which causes the tip end of the bound sheet bundle to be inclined more toward the left side in the drawing.

Figure 13:
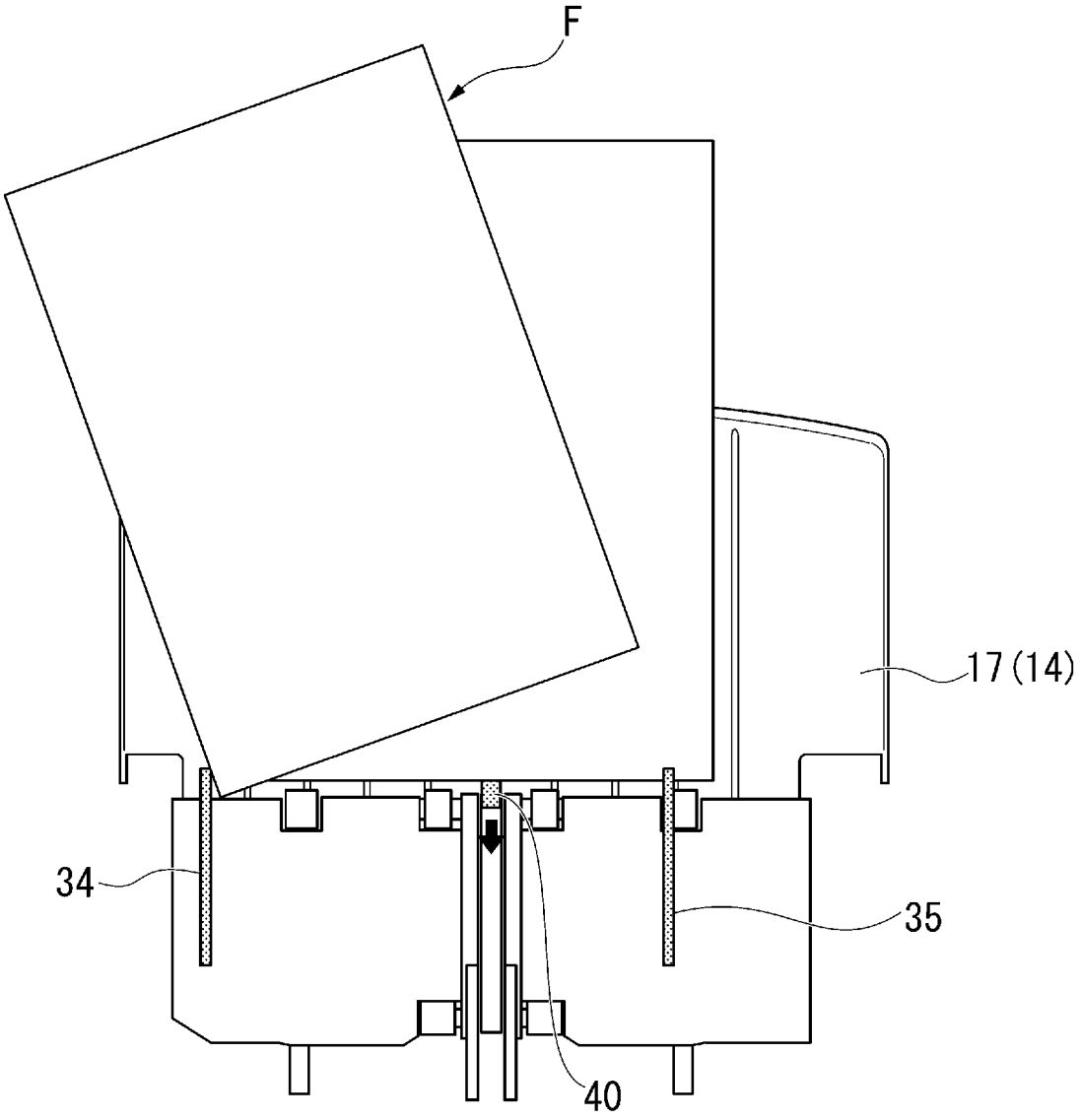
FIG. 13 is another diagram illustrating the series of flow of the shift operation.

FIG. 13 illustrates a state in which the bound sheet bundle discharged in the second shift operation is stacked on the bound sheet bundle discharged in the first shift operation. FIG. 13 illustrates a case where the first shift position is the same as the position of the second horizontal alignment plate 35 during aligning. That is, FIG. 13 illustrates a case where the bound sheet bundle is substantially discharged as it is without being shifted during the first shift operation. For that reason, the bound sheet bundle discharged in the first shift operation is not inclined, and only the bound sheet bundle discharged in the second shift operation is inclined and stacked.

As such, according to the related art, the discharged bound sheet bundle may be stacked on the tray with the tip end inclined in the shift direction. If the bound sheet bundle is inclined too much, the bound sheet bundle may fall from the tray.

In contrast, a series of flow of the shift operation by the shift mechanism 50 of this embodiment will be described below. FIG. 14 to FIG. 18 are diagrams illustrating a series of flow of the shift operation by the shift mechanism 50 of this embodiment. FIG. 14 to FIG. 18 illustrate a flow of the second shift operation in which the side surface on the binding position side of the bound sheet bundle is positioned at the second shift position.

Although the description of the flow of the first shift operation is omitted, the first shift operation is basically the same as that of the second shift operation described below. In the first shift operation, moving directions of the horizontal alignment plates 34 and 35 and the sheet bundle are only opposite to those of the second shift operation described below. Alternatively, the first shift operation may be a discharge operation that does not shift the bound sheet bundle.

Figure 14:
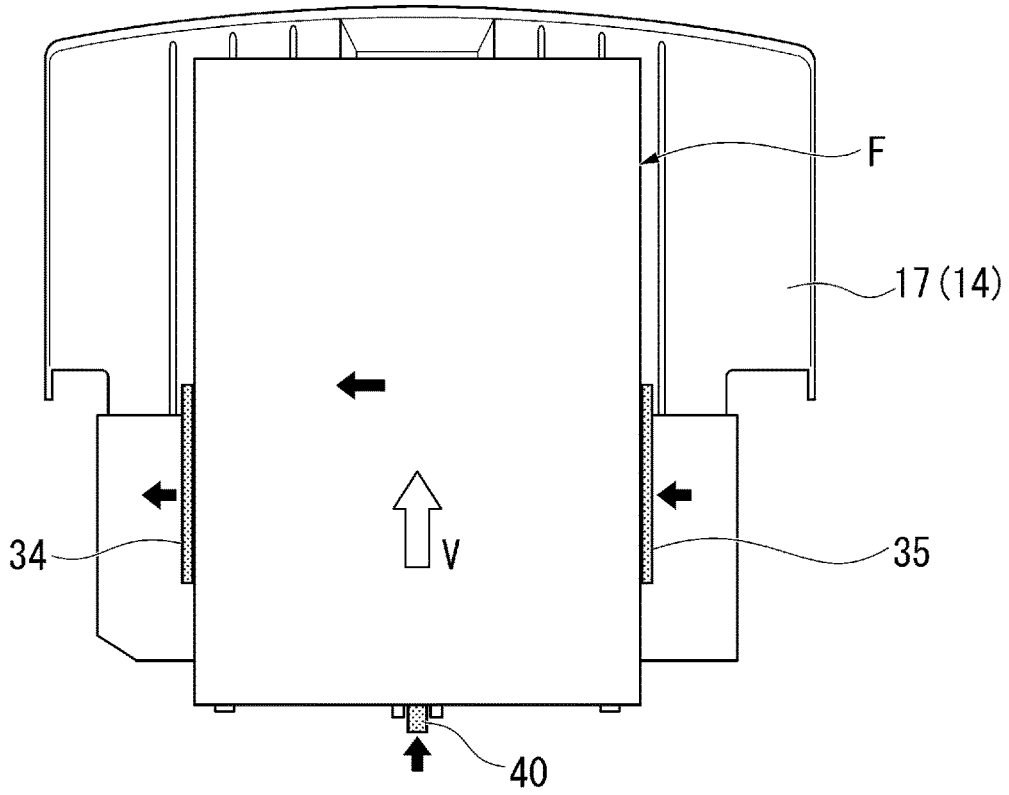
FIG. 14 is a diagram illustrating a series of flow of a shift operation by the shift mechanism.

FIG. 14 illustrates a state at a point in time when the discharge of the bound sheet bundle is started. At this point in time, the second horizontal alignment plate 35 is positioned at the first shift position. At this point in time, the holding claw 40 is positioned on the most upstream side in the sheet conveyance direction V in a movable range.

From this state, the holding claw 40 moves while pushing the bound sheet bundle toward the downstream side in the sheet conveyance direction V by the moving mechanism 51. At the same time, the first horizontal alignment plate 34 and the second horizontal alignment plate 35 move from the right side toward the left side of FIG. 14 while maintaining sheet width spacing. In this case, the second horizontal alignment plate 35 moves from the first shift position to the second shift position.

However, in at least one embodiment, the second horizontal alignment plate 35 moves from the first shift position to the second shift position by dividing the number of times for the shift operation into two times. That is, the second horizontal alignment plate 35 temporarily stops while moving from the first shift position to the second shift position, and then performs an operation of resuming movement again. On the other hand, the first horizontal alignment plate 34 moves without being temporarily stopped in the middle.

In this embodiment, the second horizontal alignment plate 35 is configured to perform the shift operation by dividing the number of times for the shift operation into in two times, but may be configured to perform the shift operation by dividing the number of times for the shift operation into three or more times. The second horizontal alignment plate 35 may be configured such that the second horizontal alignment plate 35 is not temporarily stopped but the moving speed of the second horizontal alignment plate 35 is temporarily slowed down.

Figure 15:
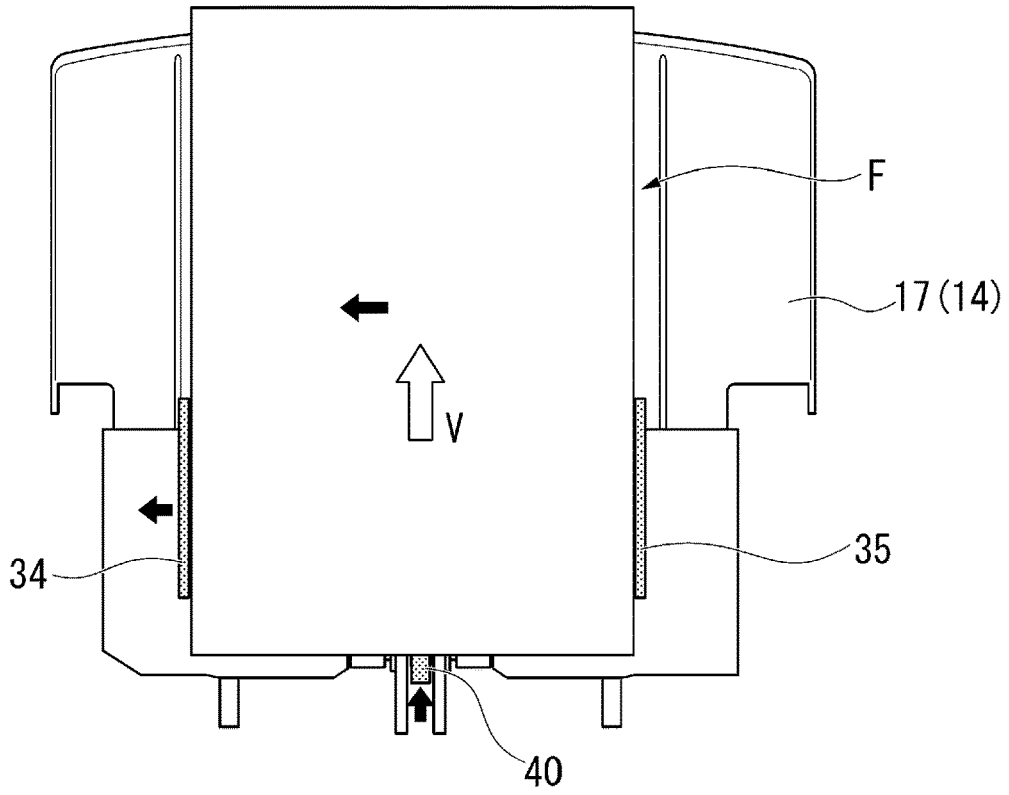
FIG. 15 is a diagram illustrating a series of flow of the shift operation by the shift mechanism.

FIG. 15 illustrates the state at the point in time when the discharge of the bound sheet bundle is started and the shift operation is being performed. At this point in time, the second horizontal alignment plate 35 is positioned between the first shift position and the second shift position. At this point in time, the holding claw 40 is positioned between the most upstream side position and the most downstream side position in the sheet conveyance direction V in the movable range.

At this point in time, the bound sheet bundle is guided from both sides by the first horizontal alignment plate 34 and the second horizontal alignment plate 35, and is carried straight along the sheet conveyance direction V.

Figure 16:
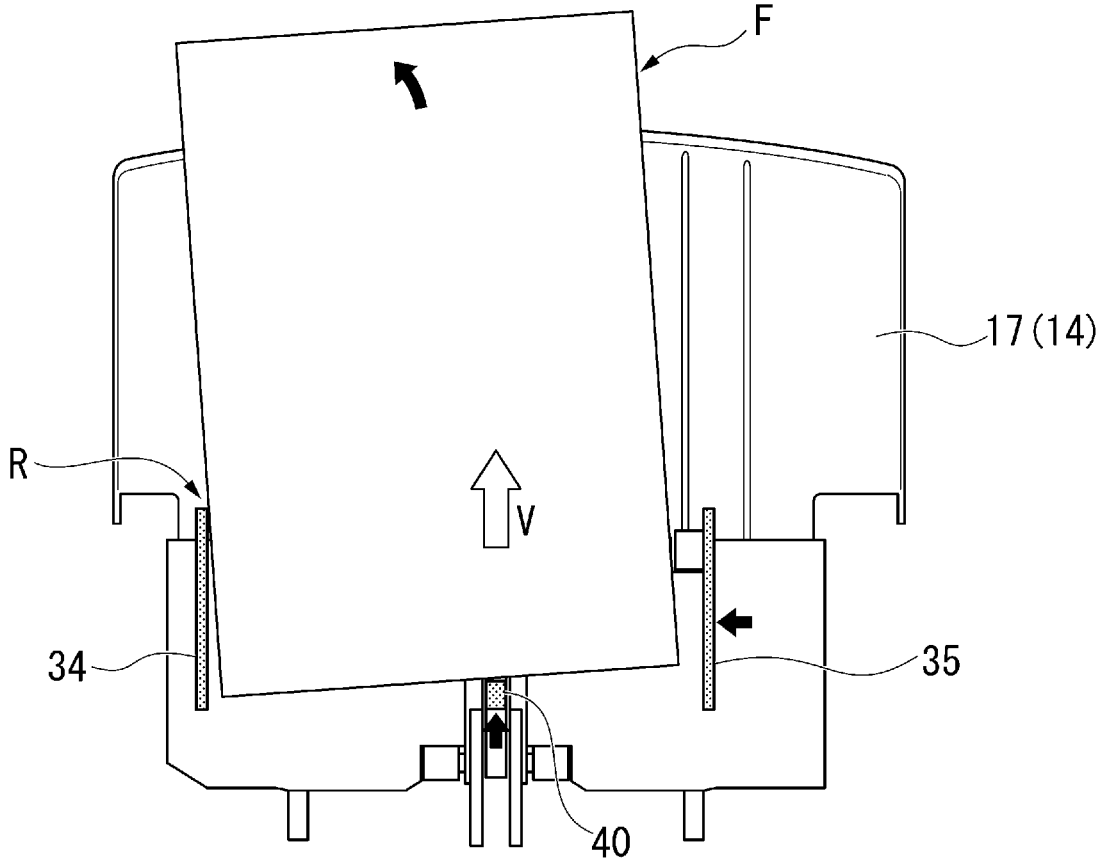
FIG. 16 is another diagram illustrating the series of flow of the shift operation by the shift mechanism.

FIG. 16 illustrates a state at the point in time when the movement of the second horizontal alignment plate 35 is temporarily stopped and then the movement of the first horizontal alignment plate 34 is completed first.

As described above, if the bound sheet bundle is discharged to the movable tray 17 or the like while being shifted in the sheet width direction W, inertia still acts on the bound sheet bundle even after the shift operation is stopped. That is, even after the second horizontal alignment plate 35 is stopped, an inertial force that tries to continue moving in the sheet width direction W remains in the bound sheet bundle. The linear motion of the bound sheet bundle in the sheet width direction W changes to a rotational motion with the contact position R between the portion near the rear end portion of the bound sheet bundle and the first horizontal alignment plate 34 acts as a fulcrum.

However, unlike the related art described above, in at least one embodiment, the second horizontal alignment plate 35 is temporarily stopped during the shift operation. With this configuration, the inertial force in the sheet width direction W acting on the bound sheet bundle is weakened. For that reason, the inclination of the discharged bound sheet bundle is smaller than that in the case of the related art described above. As illustrated in FIG. 16, the inclination of the bound sheet bundle is smaller than the inclination of the bound sheet bundle illustrated in FIG. 12.

Figure 17:
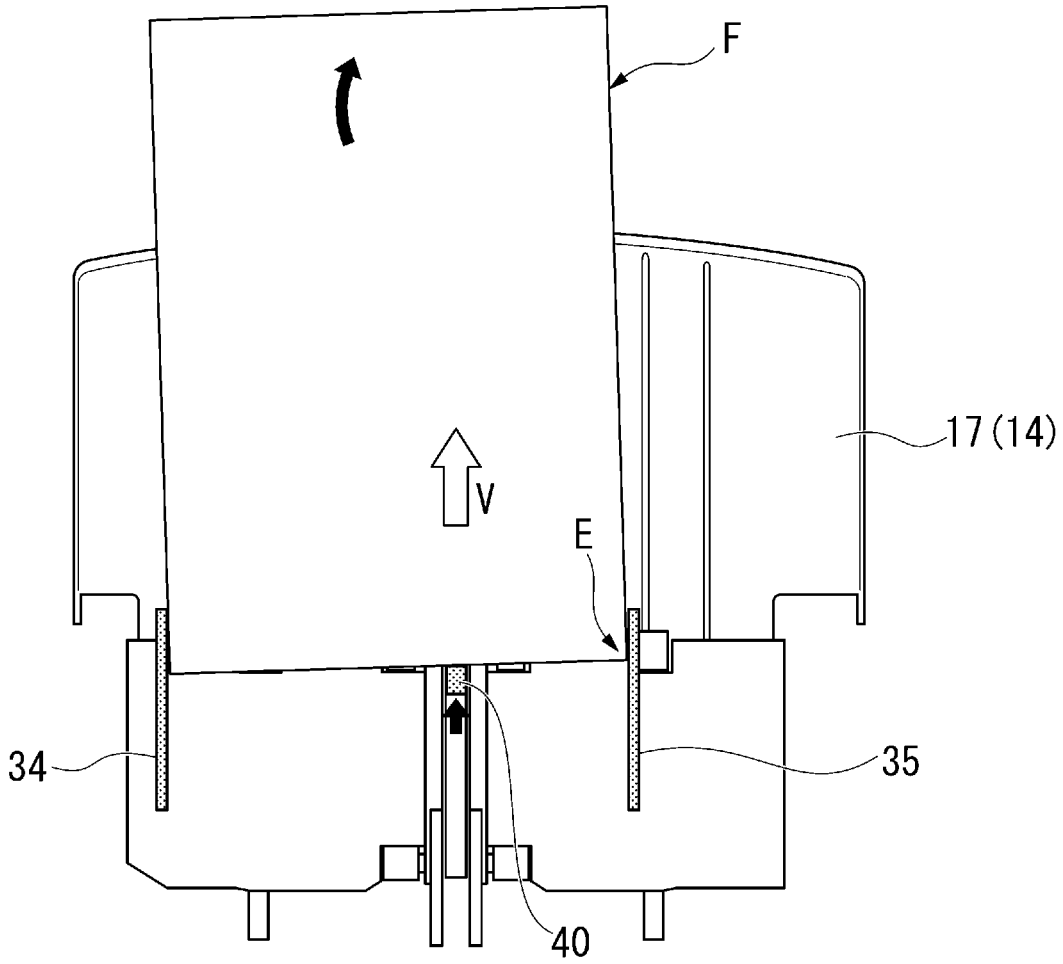
FIG. 17 is another diagram illustrating the series of flow of the shift operation by the shift mechanism.

FIG. 17 illustrates a state at a point in time when the second horizontal alignment plate 35 resumes movement after being temporarily stopped and comes into contact with the bound sheet bundle again. At this point in time, the second horizontal alignment plate 35 is positioned between the first shift position and the second shift position. At this point in time, the holding claw 40 is positioned at the most downstream side position in the sheet conveyance direction V in the movable range.

Since the bound sheet bundle is inclined, if the second horizontal alignment plate 35 comes into contact with the bound sheet bundle again, the corner of the rear end portion of the bound sheet bundle comes into contact with the second horizontal alignment plate 35. Since the second horizontal alignment plate 35 tries to move to the second shift position, the corner of the rear end portion of the bound sheet bundle is pushed again. With this configuration, the inclination of the bound sheet bundle is corrected.

Figure 18:
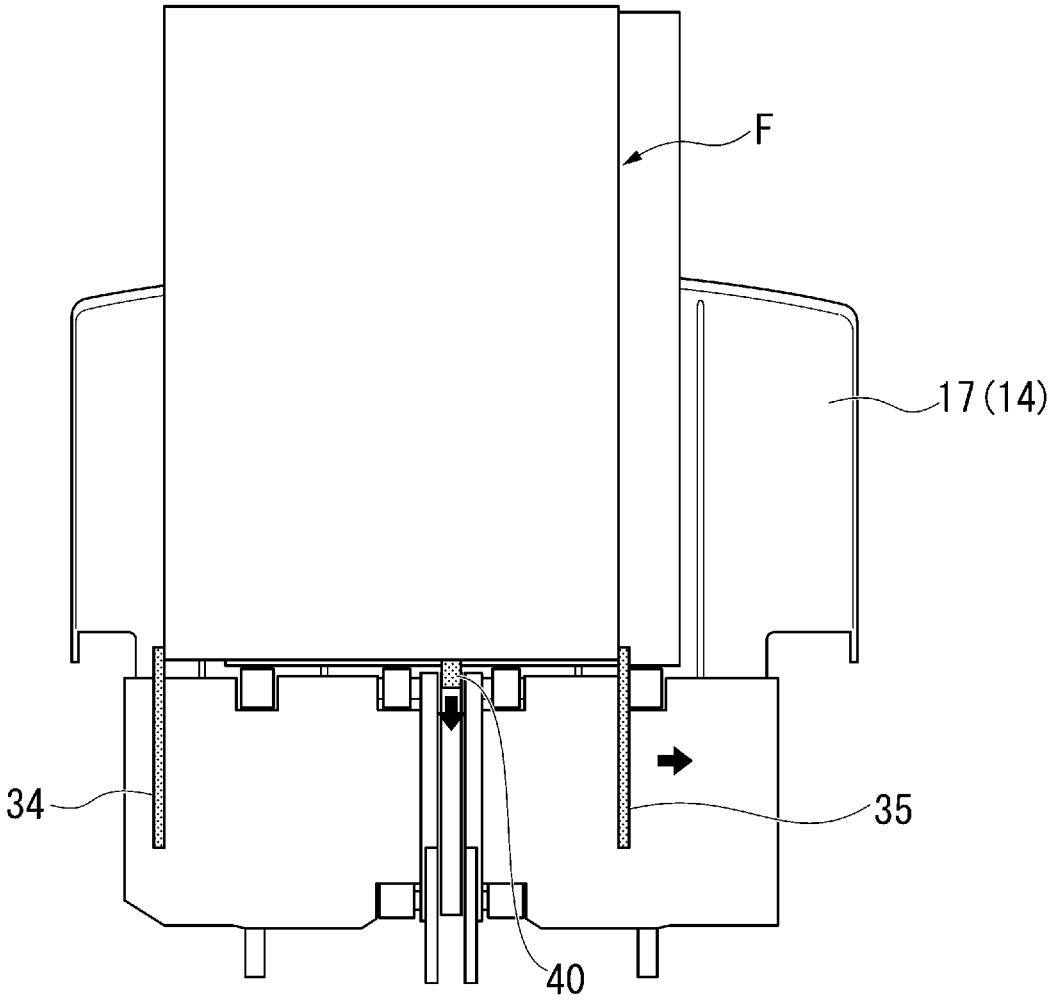
FIG. 18 is another diagram illustrating the series of flow of the shift operation by the shift mechanism.

FIG. 18 illustrates a state in which the bound sheet bundle discharged in the second shift operation is stacked on the bound sheet bundle discharged in the first shift operation. As described above, the inertial force acting on the bound sheet bundle weakens due to the temporary stop of the second horizontal alignment plate 35 and the occurrence of inclination of the bound sheet bundle is suppressed. Furthermore, the inclination of the bound sheet bundle is corrected by further pushing the corner of the rear end portion of the bound sheet bundle by the second horizontal alignment plate 35.

With this configuration, as illustrated in FIG. 18, the bound sheet bundle discharged in the first shift operation and the bound sheet bundle discharged in the second shift operation are alternately stacked on the movable tray 17 or the like while suppressing the inclination.

As described above, the sheet post-processing apparatus 3 of the first embodiment includes the stapler 38 (binding mechanism), the movable tray 17, the shift mechanism 50, the post-processing control unit 15 (control unit), and the like. The stapler 38 applies binding to the sheet bundle. The bound sheet bundle applied with binding is stacked on the movable tray 17. The shift mechanism 50 performs the shift operation of pushing the side surface of the bound sheet bundle parallel to the sheet conveyance direction V (discharge direction) and deviating the bound sheet bundle in the sheet width direction W orthogonal to the discharge direction, during discharge of the bound sheet bundle to the movable tray 17. The post-processing control unit causes the shift operation to be performed by dividing the number of times for the shift operation into a plurality of times.

By being provided with the configuration as above, the sheet post-processing apparatus 3 of the first embodiment can weaken the inertial force acting on the bound sheet bundle, and can suppress the occurrence of inclination of the bound sheet bundle. Furthermore, by being provided with the configuration as above, the sheet post-processing apparatus 3 of the first embodiment can correct the inclination of the bound sheet bundle by further pushing the corner of the rear end portion of the inclined bound sheet bundle.

With this configuration, the sheet post-processing apparatus 3 of the embodiment can suppress the occurrence of inclination of the sheet bundle stacked on the tray.

Hereinafter, a second embodiment will be described.

The appropriate timing for the second horizontal alignment plate 35 that pushes out the bound sheet bundle to temporarily stop and resume movement differs depending on the size and type of the sheet and the like. For example, if the sheet size is small, the length (hereinafter, referred to as a "shift length") that the shift mechanism 50 shifts the bound sheet bundle also needs to be shortened.

If the shift length is short, if the movement of the second horizontal alignment plate 35 is resumed too early after the second horizontal alignment plate 35 is temporarily stopped, the effect of correcting the inclination of the bound sheet bundle is diminished. This is because if the movement is resumed at an early timing, the bound sheet bundle is still in the process of being moved by the inertial force at that time, and the bound sheet bundle is in the state of not yet being greatly inclined. For that reason, a distance between the second horizontal alignment plate 35 and the corner of the rear end portion of the bound sheet bundle is in a state in which the distance is relatively large. In this state, if the second horizontal alignment plate 35 pushes the corner of the rear end portion of the bound sheet bundle, a length that the bound sheet bundle is pushed is shortened, and thus the effect of correcting the inclination of the bound sheet bundle is reduced.

In contrast, a period until the second horizontal alignment plate 35 is temporarily stopped and resumes the movement (hereinafter, referred to as a "temporarily stop period") of the shift mechanism 50 in the second embodiment is changed according to the size of the sheet and the like.

For example, the post-processing control unit 15 acquires information indicating the size of the sheet from the image forming apparatus 2. The post-processing control unit 15 controls the shift mechanism 50 according to the size of the sheet based on the acquired information so that the temporarily stop period of the second horizontal alignment plate 35 becomes an appropriate length. For example, if the size of the sheet based on the information acquired from the image forming apparatus 2 is relatively small, the post-processing control unit 15 controls so that the temporarily stop period of the second horizontal alignment plate 35 is relatively long.

As described above, the post-processing control unit 15 of the sheet post-processing apparatus 3 of the second embodiment changes the timing of the shift operation by the shift mechanism 50 according to the size of the sheet and the like. For example, the post-processing control unit 15 controls so that the shorter the length that the bound sheet bundle is pushed in the sheet width direction W, the longer the time during which the shift operation of the second horizontal alignment plate 35 is temporarily stopped.

With this configuration, the second horizontal alignment plate 35 can push the corner of the rear end portion of the bound sheet bundle in a state where the distance between the rear end portion of the bound sheet bundle and the corner is not relatively large. In this case, since it is possible to make the distance that the second horizontal alignment plate 35 pushes the corner of the rear end portion of the inclined bound sheet bundle relatively long, the inclination of the bound sheet bundle can be corrected more effectively.

Hereinafter, other modification examples of the embodiment will be described.

The first horizontal alignment plate 34 and the second horizontal alignment plate 35 are not limited to moving at the same and constant speed. The second horizontal alignment plate 35 may be configured to move at the same speed as the first horizontal alignment plate 34 from the start of the shift operation to the temporary stop of the second horizontal alignment plate 35 and move at a speed higher than that of the first horizontal alignment plate 34 while the second horizontal alignment plate 35 is moved again after being temporarily stopped. With this configuration, for example, the time required for the discharge the bound sheet bundle can be further shortened.

The first shift operation and the second shift operation are not limited to stacking one bound sheet bundle on the movable tray 17. For example, a configuration in which a plurality of bound sheet bundles are stacked on the movable tray 17 by the first shift operation and the second shift operation may be adopted. In at least one of the first shift operation and the second shift operation, the number of bound sheet bundles to be stacked on the movable tray 17 may be changed according to the required specifications.

The shift mechanism 50 is not limited to the configuration including the horizontal alignment plates 34 and 35. For example, the shift mechanism 50 may include a member different from the horizontal alignment plate instead. For example, the member different from the horizontal alignment plate is a member dedicated to the shift operation or the like. The member dedicated to the shift operation is a member that does not perform any processing other than the shift operation such as aligning. For example, the mode of the shift mechanism 50 can be changed according to the required specifications.

The shift mechanism 50 is not limited to the configuration including the holding claw 40 capable of holding the bound sheet bundle from the upstream side in the sheet conveyance direction V and the moving mechanism 51 capable of moving the holding claw 40 toward the downstream side in the sheet conveyance direction V during discharge of the bound sheet bundle. For example, the shift mechanism 50 may not include the holding claw 40 and the moving mechanism 51. For example, the shift mechanism 50 maybe configured to discharge the bound sheet bundle only by the discharge drive roller 42.

The shift mechanism 50 is not limited to a configuration in which the bound sheet bundle is shifted in a state where the spacing between the pair of horizontal alignment plates 34 and 35 in the sheet width direction W is the same as the sheet width of the bound sheet bundle during conveyance of the bound sheet bundle. For example, the shift mechanism 50 may shift the bound sheet bundle in a state where the spacing between the pair of horizontal alignment plates 34 and 35 in the sheet width direction W is made larger than the sheet width of the bound sheet bundle during discharge of the bound sheet bundle.

That is, the shift mechanism 50 may have a gap between the horizontal alignment plates 34 and 35 and the bound sheet bundle during discharge of the bound sheet bundle. For example, the difference (hereinafter referred to as "gap width") between the spacing between the pair of horizontal alignment plates 34 and 35 in the sheet width direction W and the sheet width of the bound sheet bundle may be set to a size capable of absorbing the behavior of the bound sheet bundle during discharge of the bound sheet bundle. In this case, the shift mechanism 50 can stably discharge the bound sheet bundle as compared with the case where the bound sheet bundle is shifted in a state where the spacing between the pair of horizontal alignment plates 34 and 35 in the sheet width direction W is the same as the sheet width of the bound sheet bundle during conveyance of the bound sheet bundle.

In this case, for example, the gap width may be set according to information such as the size of the sheet width of the bound sheet bundle, the number of sheets configuring the bound sheet bundle, and conditions such as the discharge speed of the bound sheet bundle. The shift mechanism 50 may change the size of the gap width during discharge of the bound sheet bundle by moving the horizontal alignment plates 34 and 35 in the sheet width direction W.

As described above, the image processing apparatus in the embodiment is an image forming apparatus that forms an image on a sheet. In contrast, the image processing apparatus may be a decoloring apparatus that decolors the image formed on the sheet. For example, the decoloring decolors (erase) an image formed on a sheet with a decolorable toner.

In the embodiment described above, a configuration in which the binding is applied to one place in the vicinity of the upper right corner of the sheet bundle is adopted, but is not limited thereto. For example, a configuration in which binding is applied to two or more predetermined positions on the sheet bundle may be adopted. For example, even in a configuration in which the sheet bundle is discharged without being applied with binding, the effect of correcting the inclination of the sheet bundle in the embodiment described above is effective. A configuration in which the shift operation is performed for each sheet to be discharged instead of the sheet bundle may be adopted.

The configuration of the sheet post-processing apparatus 3 in at least one embodiment described above is presumed to have a particularly high effect of correcting the inclination for a bound sheet bundle of long paper, a bound sheet bundle of about twenty sheets, and a bound sheet bundle that is applied with binding at one place. However, the bound sheet bundle targeted for correction of the inclination is not limited to such a bound sheet bundle.

While certain embodiments have been described, these embodiments have been presented by way of example only, and are not intended to limit the scope of the disclosure. Indeed, the novel embodiments described herein may be embodied in a variety of other forms; furthermore, various omissions, substitutions and changes in the form of the embodiments described herein may be made without departing from the spirit of the disclosure. The accompanying claims and their equivalents are intended to cover such forms or modifications as would fall within the scope and spirit of the disclosure.

What is claimed is:

1. A sheet post-processing apparatus comprising:

a binder configured to apply binding to a sheet;

a tray on which the sheet applied with the binding is stacked;

a shifter configured to perform a shift operation in which a side surface of the sheet is pushed and the sheet deviates in a sheet width direction orthogonal to a discharge direction during discharge of the sheet to the tray; and a controller configured to cause the shift operation to be performed by dividing the number of times for the shift operation into a plurality of times, the shifter including a second horizontal alignment plate configured to perform the shift operation, and further including a first horizontal alignment plate disposed on a side opposite to the second horizontal alignment plate with respect to the sheet and configured to perform an operation of guiding the sheet pushed by the second horizontal alignment plate while moving in the sheet width direction, and the controller being configured to cause the shift operation by the second horizontal alignment plate to be performed by dividing the number of times for the shift operation into a plurality of times and to cause the operation of guiding the sheet by the first horizontal alignment plate to be performed without dividing the number of times for the shift operation into a plurality of times.

2. The apparatus according to claim 1, wherein the second horizontal alignment plate is arranged to correct an inclination of the sheet by pushing a corner of the sheet which is inclined in the shift operation.

3. The apparatus according to claim 1, wherein the first horizontal alignment plate and the second horizontal alignment plate are configured to move at a same and a constant speed when moving.

4. The apparatus according to claim 1, wherein the controller is configured to cause the second horizontal alignment plate to move at a same speed as that of the first horizontal alignment plate from the start of the shift operation to the temporary stop of the second horizontal alignment plate, and to cause the second horizontal alignment plate to move at a speed faster than that of the first horizontal alignment plate when the second horizontal alignment plate is moved again after being temporarily stopped.

5. The apparatus according to claim 1, wherein the second horizontal alignment plate is configured to perform the shift operation of pushing a side surface of the sheet on a binding position side.

6. The apparatus according to claim 1, wherein the shifter further includes a holding claw arranged to hold the sheet from an upstream side in the discharge direction and includes a mover arranged to move the holding claw toward a downstream side in the discharge direction during discharge of the sheet to the tray.

7. The apparatus according to claim 1, wherein the controller is configured to cause the shift operation to alternate between a first shift operation and a second shift operation.

8. The apparatus according to claim 1, wherein the sheet applied with the binding includes a bound sheet bundle.

9. The apparatus according to claim 1, wherein the binder includes a stapler.

10. The apparatus according to claim 1, further comprising an ejector configured to discharge the sheet applied with the binding.

11. A sheet post-processing apparatus comprising:

a binder configured to apply binding to a sheet;

a tray on which the sheet applied with the binding is stacked;

a shifter configured to perform a shift operation in which a side surface of the sheet is pushed and the sheet deviates in a sheet width direction orthogonal to a discharge direction during discharge of the sheet to the tray; and a controller configured to cause the shift operation to be performed by dividing the number of times for the shift operation into a plurality of times, wherein the controller is configured to temporarily stop the shift operation during discharge of the sheet to the tray, and wherein the controller is configured to cause the time for temporarily stopping the shift operation to be longer as a length that the shifter pushes the sheet in the sheet width direction becomes shorter.

12. The apparatus according to claim 11, wherein the controller is configured to determine an interval of a timing at which the shifter starts pushing the sheet in the shift operation performed in the plurality of times, the plurality of times obtained by dividing the number of times for the shift operation regardless of a distance that the shifter pushes the sheet in the sheet width direction.

13. A method of operating a sheet post-processing apparatus, the apparatus comprising a binder configured to apply binding to a sheet, and a tray on which the sheet applied with the binding is stacked, the method comprising:

performing a shift operation in which a side surface of the sheet is pushed and the sheet deviates in a sheet width direction orthogonal to a discharge direction during discharge of the sheet to the tray;

causing the shift operation to be performed by dividing the number of times for the shift operation into a plurality of times;

temporarily stopping the shift operation during discharge of the sheet to the tray; and causing the time for temporarily stopping the shift operation to be longer as a length that the shifting pushes the sheet in the sheet width direction becomes shorter.

14. The method according to claim 13, further comprising determining an interval of a timing at which the shifting starts pushing the sheet in the shift operation performed in the plurality of times, the plurality of times obtained by dividing the number of times for the shift operation regardless of a distance that the shifting pushes the sheet in the sheet width direction.

15. The method according to claim 14, further comprising holding the sheet from an upstream side in the discharge direction and moving the sheet toward a downstream side in the discharge direction during discharge of the sheet to the tray.

* * * * *